US012723343B2

(12) United States Patent
Lee et al.

(10) Patent No.: US 12,723,343 B2
(45) Date of Patent: Sep. 1, 2026

(54) LAUNDRY TREATING APPARATUS

(71) Applicant: LG ELECTRONICS INC., Seoul (KR)

(72) Inventors: Kilryong Lee, Seoul (KR); Bokyung Cho, Seoul (KR); Yongwoo Kwon, Seoul (KR); Inseong Hwang, Seoul (KR); Hakryeol Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 99 days.

(21) Appl. No.: 18/873,256

(22) PCT Filed: Jun. 15, 2023

(86) PCT No.: PCT/KR2023/008289
§ 371 (c)(1),
(2) Date: Dec. 9, 2024

(87) PCT Pub. No.: WO2023/244033
PCT Pub. Date: Dec. 21, 2023

(65) Prior Publication Data

US 2025/0327235 A1 Oct. 23, 2025

(30) Foreign Application Priority Data

Jun. 16, 2022 (KR) ..... 10-2022-0073449

(51) Int. Cl.
*D06F 23/02* (2006.01)
*D06F 25/00* (2006.01)
(Continued)

(52) U.S. Cl.
CPC ..... *D06F 39/02* (2013.01); *D06F 23/02* (2013.01); *D06F 25/00* (2013.01); *D06F 31/00* (2013.01);
(Continued)

(58) Field of Classification Search
None
See application file for complete search history.

(56) References Cited

FOREIGN PATENT DOCUMENTS

EP 2837727 A1 2/2015
EP 2876198 A1 5/2015
(Continued)

*Primary Examiner* — Levon J Shahinian
(74) *Attorney, Agent, or Firm* — Bryan Cave Leighton Paisner LLP

(57) ABSTRACT

A laundry treating apparatus is disclosed and a laundry treating apparatus according to an embodiment of the present disclosure comprises: a cabinet; a tub; a drum; an opening circumferential part extending along the circumference of a detergent opening and protruding toward the inside of the cabinet; and an insertion case coupled to the opening circumferential part at the inside of the cabinet and accommodating at least a part of a storage unit inserted into the cabinet, wherein the insertion case includes a protrusion coupling part having a first insertion groove formed to be recessed away from the opening circumferential part at a part facing the opening circumferential part, the opening circumferential part has a second insertion groove formed to be recessed away from the protrusion coupling part at a part facing the first insertion groove, and the protrusion coupling part is inserted into the second insertion groove while the opening circumferential part is inserted into the first insertion groove.

20 Claims, 24 Drawing Sheets

(51) Int. Cl.

| | |
|---|---|
| ***D06F 31/00*** | (2006.01) |
| ***D06F 37/26*** | (2006.01) |
| ***D06F 37/42*** | (2006.01) |
| ***D06F 39/02*** | (2006.01) |
| ***D06F 39/12*** | (2006.01) |
| ***D06F 58/20*** | (2006.01) |

(52) U.S. Cl.
CPC ..... *D06F 37/263* (2013.01); *D06F 37/264* (2013.01); *D06F 37/42* (2013.01); *D06F 39/12* (2013.01); *D06F 39/125* (2013.01); *D06F 58/20* (2013.01)

(56) References Cited

FOREIGN PATENT DOCUMENTS

| | | | |
|---|---|---|---|
| EP | 3786339 | A1 | 3/2021 |
| EP | 3868944 | A1 | 8/2021 |
| KR | 20070067466 | A | 6/2007 |
| KR | 20180090003 | A | 8/2018 |
| KR | 20210106195 | A | 8/2021 |
| KR | 20210106320 | A | 8/2021 |
| KR | 20220041369 | A | 4/2022 |

1

LAUNDRY TREATING APPARATUS

CROSS-REFERENCE TO PRIOR APPLICATIONS

This application is a National Stage of PCT/KR2023/008289, filed Jun. 15, 2023, (published on Dec. 21, 2023, as WO 2023/244033 A1), which claims priority to Korean Patent Application No. 10-2022-0073449, filed Jun. 16, 2022, each hereby expressly incorporated by reference in its entirety.

TECHNICAL FIELD

The present disclosure relates to a laundry treating apparatus, and more particularly, to a laundry treating apparatus including a front panel defining a front surface.

BACKGROUND

A laundry treating apparatus is an apparatus that performs necessary processing on laundry, such as placing laundry, for example, clothing or bedding, inside a drum, removing contamination from laundry or drying laundry.

When the laundry treating apparatus is provided to remove contamination from laundry, the laundry treating apparatus performs processes such as washing, rinsing, dehydration, and drying, and the laundry treating apparatus may be classified into a top-loading type apparatus and a front-loading type apparatus based on a method of putting laundry into a drum.

The laundry treating apparatus includes a cabinet defining an outer apparatus, a tub accommodated inside the cabinet, a drum rotatably mounted inside the tub and into which laundry is fed, and a detergent supply device that supplies detergent into the drum.

When the drum rotates by a motor while washing water is supplied to the laundry contained in the drum, dirt on the laundry may be removed through friction with the drum and the washing water.

The detergent supply device has a detergent supply function to enhance a washing effect. Here, the detergent refers to substances that enhance the washing effect, such as fabric detergent, fabric softener, and fabric bleach. The detergent may be used in powder form or liquid form.

When the laundry treating apparatus is configured to dry laundry, the laundry treating apparatus may provide dry air to the laundry and remove moisture from the laundry.

The laundry treating apparatus includes a cabinet, a drum rotatably provided inside the cabinet, and a heater for heating or drying air provided to laundry.

Moisture present in the laundry may be evaporated and removed by dry air, and moisture in the laundry may be removed by supplying the dry air to the laundry contained in the drum.

Cited reference KR 10-2007-0067466 A1 discloses a laundry treating apparatus including a plurality of treating devices. That is, the laundry treating apparatus further includes a basic treating device including a cabinet and an additional treating device located outside the basic treating device.

To improve convenience of use, a laundry treating apparatus may be provided to a user by having multiple treating devices that are separated from each other and stacked on each other together, and the user may use each of the multiple treating devices according to usage conditions.

Cited reference KR 10-2018-0090003 A1 discloses a detergent supply unit provided in a laundry treating apparatus. In the laundry treating apparatus, a storage unit of the detergent supply unit is retracted or extended into or out of the cabinet by the user.

The storage unit may be retracted or extended through a detergent opening of the cabinet, and during this process, when detergent is unintentionally leaked from the detergent storage unit to a part of the cabinet around the detergent opening, a part of the cabinet may collide, thereby reducing durability, and damage such as scratches may occur on a surface of the storage unit due to edges around the detergent opening in the cabinet.

Therefore, it is an important to effectively prevent the durability of the cabinet from being degraded or damage to the storage unit caused by the storage unit retracted or extended into or out of the cabinet.

When a device for preventing contact between the cabinet and the storage unit or the detergent surrounds the detergent opening corresponding to a passage of the storage unit, it is important to ensure stable fixation and rigidity of the device.

DISCLOSURE

Technical Problem

Embodiments of the present embodiment are to provide a laundry treating apparatus that effectively prevents corrosion or deformation of a cabinet and effectively improve durability of the cabinet.

Embodiments of the present disclosure are to provide a laundry treating apparatus that effectively prevents damage such as scratches from occurring to a storage unit of a cabinet or detergent supply unit.

Embodiments of the present disclosure are to provide a laundry treating apparatus including a detergent supply unit having excellent structural stability and effectively ensuring the stability of bonding.

Embodiments of the present disclosure are to provide a laundry treating apparatus for effectively preventing sagging of a case periphery of a retract case and improving the durability thereof.

Embodiments of the present disclosure are to provide a laundry treating apparatus in which a plurality of treating devices are provided together to improve convenience of use.

Technical Solution

An embodiment of the present disclosure may include a retract case located behind a detergent opening and the retract case may include a protruding joint with a first insertion groove formed therein into which an opening periphery is inserted.

The opening periphery may include a second insertion groove into which the protruding joint is inserted. The first insertion groove and the second insertion groove may be formed facing each other, and thus the opening periphery may be inserted into the first insertion groove and the protruding joint may be inserted into the second insertion groove at the same time as the retract case and the opening periphery are combined with each other.

According to an embodiment of the present disclosure, the retract case may include a first insertion groove into which an opening periphery extending along the periphery of the detergent opening is inserted, thereby effectively preventing progression of inner opening partially opening inwardly of the detergent opening.

Opening directions of the first insertion groove and the second insertion groove may correspond to each other in a cross direction, and thus multidirectional fastening may occur at a joining portion of the first insertion groove and the second insertion groove, thereby improving structural stability:

According to an embodiment of the present disclosure, a protruding joint of the retract case may protrude forward than the periphery joint, and thus a coupling position of the retract case may be effectively guided through a relationship between the protruding joint and the second insertion groove before the retract case and the opening periphery are combined with each other.

According to an embodiment of the present disclosure, a laundry treating apparatus may include a cabinet, a tub, a drum, an opening periphery, a storage unit, and a retract case.

The cabinet may include a detergent opening, the tub may be provided inside the cabinet and accommodates, the drum may be provided inside the tub and accommodates laundry, and the opening periphery may extend along the periphery of the detergent opening and protrude into the cabinet.

The storage unit may store detergent and is retracted into the cabinet through the detergent opening, and the retract case may be combined with the opening periphery inside the cabinet and may accommodate at least a portion of the storage unit retracted into the cabinet.

The retract case may include a protruding joint that extends toward the protruding joint and have a portion facing the opening periphery, in which a first insertion groove recessed away from the opening periphery is formed.

A second insertion groove recessed away from the protruding joint may be formed in a portion of the opening periphery, which faces the first insertion groove, and the protruding joint may be inserted into the second insertion groove while the opening periphery is inserted into the first insertion groove.

The protruding joint may protrude away from the storage unit in the retract case, a portion of the opening periphery, which extends in a direction crossing a protruding direction of the protruding joint, may include the second insertion groove, and the opening periphery may be inserted into the first insertion groove.

The protruding joint may be provided in plural and protruding joints may be spaced apart from each other along the periphery of the detergent opening. The detergent opening may be formed on the front panel of the cabinet, and the storage unit may be retracted into the cabinet rearwardly through the detergent opening.

The protruding joint may protrude upward from the retract case, a portion of the opening periphery, which is located above the detergent opening and extends laterally, may include the second insertion groove, and the opening periphery may be inserted into the first insertion groove.

A portion of the protruding joint, which is located behind the first insertion groove, may be inserted into the second insertion groove, and a portion of the second insertion groove, which is located in front of the second insertion groove, may be inserted into the first insertion groove.

The retract case may further include a case periphery that surrounds at least a portion of the storage unit and a periphery joint that protrudes from the case periphery and into which the opening periphery is inserted from a front side, and a front end of the protruding joint may be located in front of the periphery joint.

The protruding joint may include a body portion that protrudes outwardly from the case periphery and a forward extension that extends forwardly from the body portion and has the first insertion groove formed between the forward extension and the case periphery.

The front end of the case periphery may be surrounded by the opening periphery inside the opening periphery: The retract case may further include a through joint that protrudes outwardly from the case periphery and passes through the opening periphery.

The through joint may have a rib shape extending along a periphery direction of the detergent opening.

The through joint may be provided in plural and through joints may be spaced apart from each other along the periphery direction, and the protruding joint may be located between any one pair of through joints of the plurality of through joints.

The through joint may be located in front of the periphery joint, and a portion of the opening periphery, which is located behind the through joint, may be inserted into the periphery joint.

An open hole formed to pass through the periphery joint may be formed in a front portion of the periphery joint, at which the through joint is located. The periphery joint may further include a hole extension formed on one surface of the periphery joint, which faces the detergent opening, and recessed rearwardly while surrounding the open hole.

The periphery joint may include a third insertion groove into which the opening periphery is inserted from a front side and may include a width reducing portion that protrudes toward the case periphery such that a width of the third insertion groove is reduced.

The retract case may further include an internal partition connected to the case periphery and penetrated by the storage unit retracted into the cabinet. A front end of the storage unit, which is located in front of the internal partition, may be accommodated in the retract case, and a remaining portion excluding the front end may be retracted into the cabinet to pass through the internal partition.

The laundry treating apparatus may further include a detergent case provided inside the cabinet and located behind the retract case to accommodate the remaining portion of the storage unit except for the front end of the storage unit. The laundry treating apparatus may include a handle portion exposed to an outside of the cabinet on the front end of the storage unit.

According to an embodiment of the present disclosure, a laundry treating apparatus includes a cabinet including a detergent opening, a tub provided inside the cabinet and storing water, a drum provided inside the tub and configured to accommodate laundry, an opening periphery extending along a periphery of the detergent opening and protruding into the cabinet, a storage unit in which detergent is stored and retracted into the cabinet through the detergent opening, and a retract case combined with the opening periphery and accommodates at least a portion of the storage unit retracted into the cabinet.

The retract case may include a protruding joint protruding in a first direction and including a first insertion groove into which the opening periphery is inserted, and the opening periphery may include a second insertion groove that faces the first insertion groove and into which the protruding joint is inserted and may extend across the first direction to be inserted into the first insertion groove.

Advantageous Effects

Embodiments of the present embodiment are to provide a laundry treating apparatus that effectively prevents corrosion or deformation of a cabinet and effectively improve durability of the cabinet.

Embodiments of the present disclosure are to provide a laundry treating apparatus that effectively prevents damage such as scratches from occurring to a storage unit of a cabinet or detergent supply unit.

Embodiments of the present disclosure are to provide a laundry treating apparatus including a detergent supply unit having excellent structural stability and effectively ensuring the stability of bonding.

Embodiments of the present disclosure are to provide a laundry treating apparatus for effectively preventing sagging of a case periphery of a retract case and improving the durability thereof.

Embodiments of the present disclosure are to provide a laundry treating apparatus in which a plurality of treating devices are provided together to improve convenience of use.

DETAILED DESCRIPTION

Figure 1:
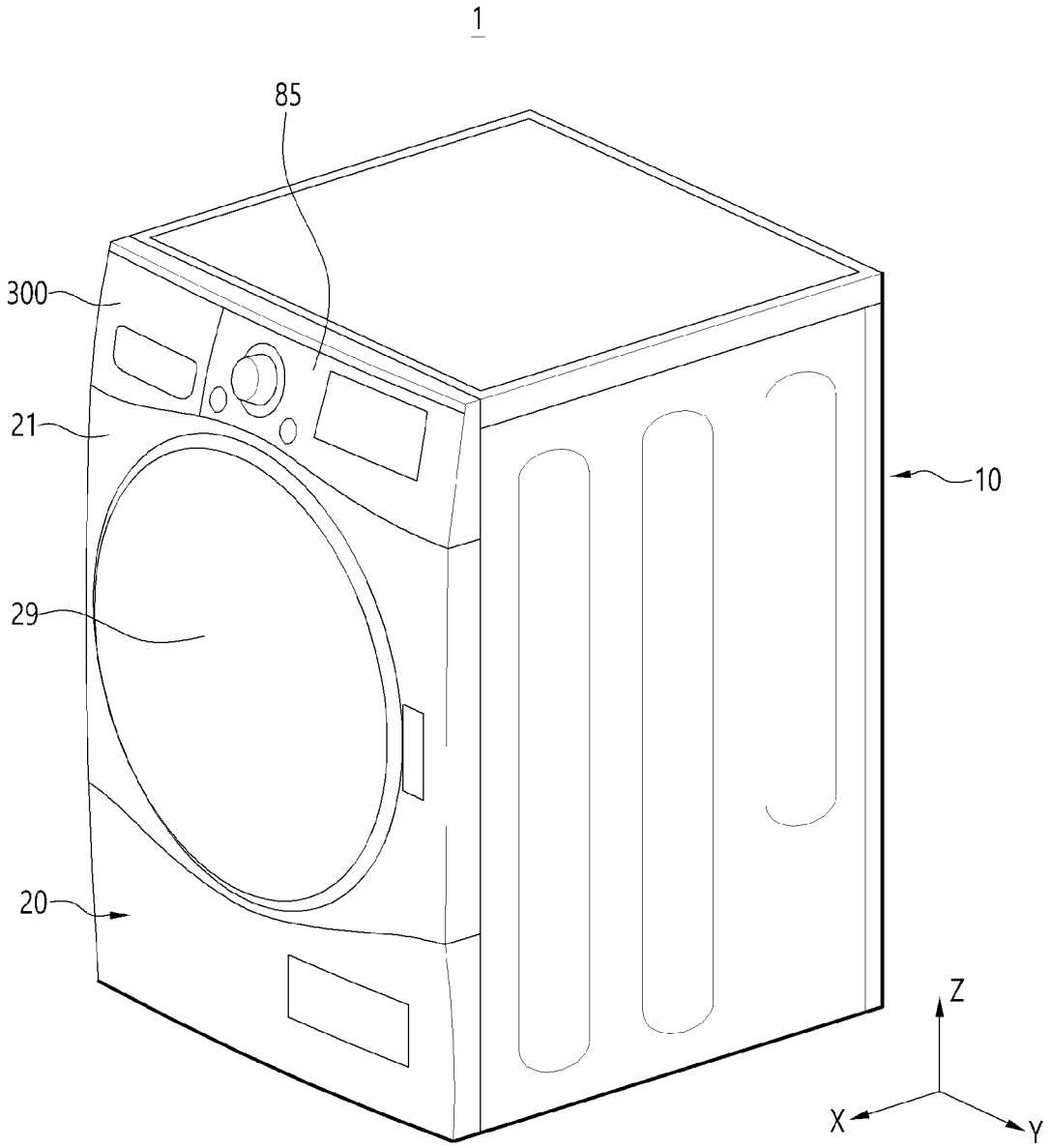
FIG. 1 is a perspective view of a laundry treating apparatus according to an embodiment of the present disclosure.

Embodiments of the present disclosure are described in detail so as for those of ordinary skill in the art to easily implement with reference to the accompanying drawings.

However, the present disclosure may be implemented in various different forms and is not limited to these embodiments. To clearly describe the present disclosure, a part without concerning to the description is omitted in the drawings, and like reference numerals in the specification denote like elements.

In the present specification, a repeated explanation of the same elements will not be given It will be understood that when an element is referred to as being "connected to" or "coupled to" another element, it may be directly on, connected or coupled to the other element or intervening elements may be present. In contrast, when an element is referred to as being "directly connected to" or "directly coupled to" another element or layer, there are no intervening elements or layers present.

The terms used in the present specification are used for explaining a specific embodiment, not limiting the present disclosure.

In the present specification, the singular expressions include the plural expressions unless clearly specified otherwise in context.

It will be further understood that the terms "comprises" and/or "comprising" when used in this specification, specify the presence of stated features, integers, steps, operations, elements, components, or combinations thereof but do not preclude the presence or addition of one or more other features, integers, steps, operations, elements, components, and/or combinations thereof.

In the present specification, the term 'and/or' includes a combination of multiple listed items or any item of multiple listed items. In the present specification, 'A or B' may include 'A', 'B', or 'both A and B'.

Hereinafter, an embodiment of the present disclosure will be described with reference to the drawings. For reference, each drawing indicates the X-direction, Y-direction and Z-direction when necessary, and unless otherwise stated, the X-direction corresponds to a longitudinal direction or front-back direction based on a cabinet 10 described below; the Y-direction corresponds to a lateral direction or width direction of the cabinet 10, and the Z-direction corresponds to a height direction or up-down direction of the cabinet 10.

FIG. 1 is a perspective view showing an outer appearance of a laundry treating apparatus 1 according to an embodiment of the present disclosure. Referring to FIG. 1, an embodiment of the present disclosure includes the cabinet 10. The cabinet 10 may define an outer appearance of the laundry treating apparatus 1 and may have a space formed therein to accommodate various components.

The cabinet 10 may include a plurality of panels. For example, the cabinet 10 may include a front panel 20 forming a front surface of the cabinet 10, a rear panel defining a rear surface, a side panel 30 defining a lateral surface, a top panel defining an upper surface, and a bottom panel or base portion 700 defining a lower surface. The side panel 30 may include a first side panel at one side in the lateral direction and a second side panel at the other side.

The cabinet 10 may include a laundry opening 28 for putting laundry inside. A user may put laundry into the cabinet 10 through the laundry opening 28. The cabinet 10 may include a laundry door 29 for opening and closing the laundry opening 28. The laundry door 29 may be rotatably connected to the cabinet 10 and may determine the opening and closing of the laundry opening 28 depending on a rotation state.

Figure 2:
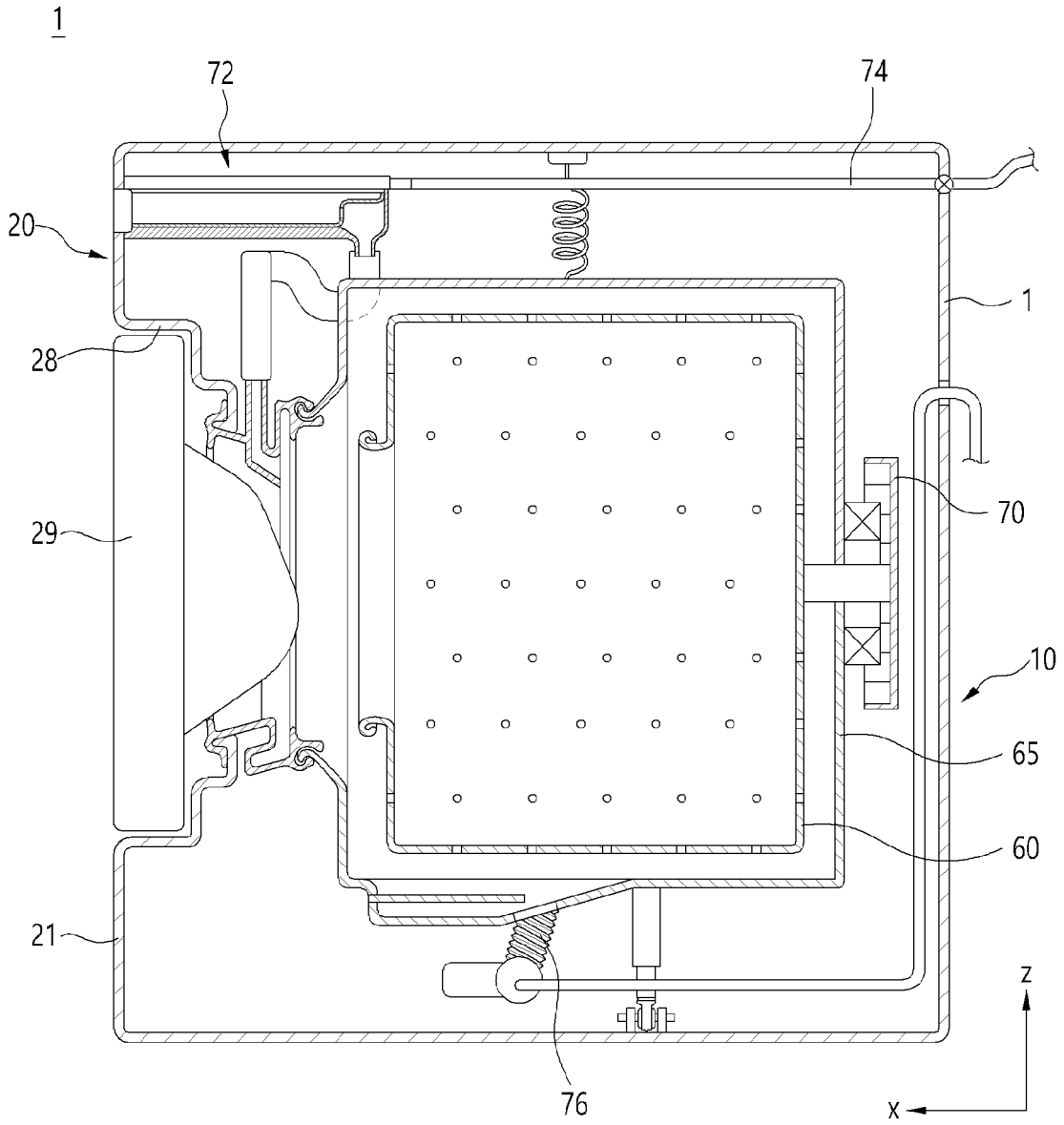
FIG. 2 is a cross-sectional view showing the inside of a laundry treating apparatus according to an embodiment of the present disclosure.

FIG. 2 conceptually illustrates the inside of the laundry treating apparatus 1 in which a washing process of laundry is performed according to an embodiment of the present disclosure. The washing process of laundry may refer to a process of removing contaminants from the laundry by using water, detergent, and the like.

That is, the laundry treating apparatus 1 according to an embodiment of the present disclosure may be a washing machine for performing the washing process of laundry. In detail, according to an embodiment of the present disclosure, a drum 60 and a tub 65 may be installed inside the cabinet 10.

The tub 65 may be provided inside the cabinet 10 to accommodate water. The tub 65 may include an opening of the tub 65, which opens toward the laundry opening 28 of the cabinet 10. Laundry input through the laundry opening 28 may be put into the tub 65 through the opening of the tub 65.

The drum 60 may be provided inside the tub 65 to accommodate laundry. The drum 60 may include an opening of the drum 60, which opens toward the laundry opening 28 and the opening of the tub 65. Laundry passing through the laundry opening 28 and the opening of the tub 65 may be put and accommodated inside the drum 60 through the opening of the drum 60.

The drum 60 may be rotatably provided inside the tub 65. The drum 60 may be connected to a driver 70 to receive rotational power. A rotation axis of the drum 60 may be approximately directed toward the laundry opening 28, and the driver 70 may be fixedly coupled to the tub 65 or cabinet 10 and connected to the drum 60 to provide rotational power.

The drum 60 may include a plurality of holes formed in an outer circumferential surface. Accordingly, water contained in the tub 65 may flow into the drum 60 through the holes formed in the outer circumferential surface of the drum 60. The drum 60 containing water and laundry therein may perform the washing process of laundry while rotating by the driver 70.

An embodiment of the present disclosure may include a detergent supply unit 72. The detergent supply unit 72 may store detergent and may supply detergent into the tub 65 when necessary during the washing process of laundry.

An embodiment of the present disclosure may include a water supply unit 74. The water supply unit 74 may be connected to an external water source and may include a water supply valve and a water supply hose. The water supply unit 74 may be connected to the detergent supply unit 72 to supply water into the tub 65 through the detergent supply unit 72, or may be directly connected to the tub 65 to supply water into the tub 65.

An embodiment of the present disclosure may include a drainage unit 76. The drainage unit 76 may include a drainage pump and a drainage hose, as needed. The drain 76 may be connected to the tub 65 to discharge water contained inside the tub 65 to the outside of the cabinet 10.

An embodiment of the present disclosure need not necessarily be provided to perform only one of the washing process or drying process of laundry, and may be provided to perform the washing process and the drying process together as needed. For example, an embodiment of the present disclosure may be provided with both the detergent supply unit 72 and an air supply unit, as needed.

Figure 3:
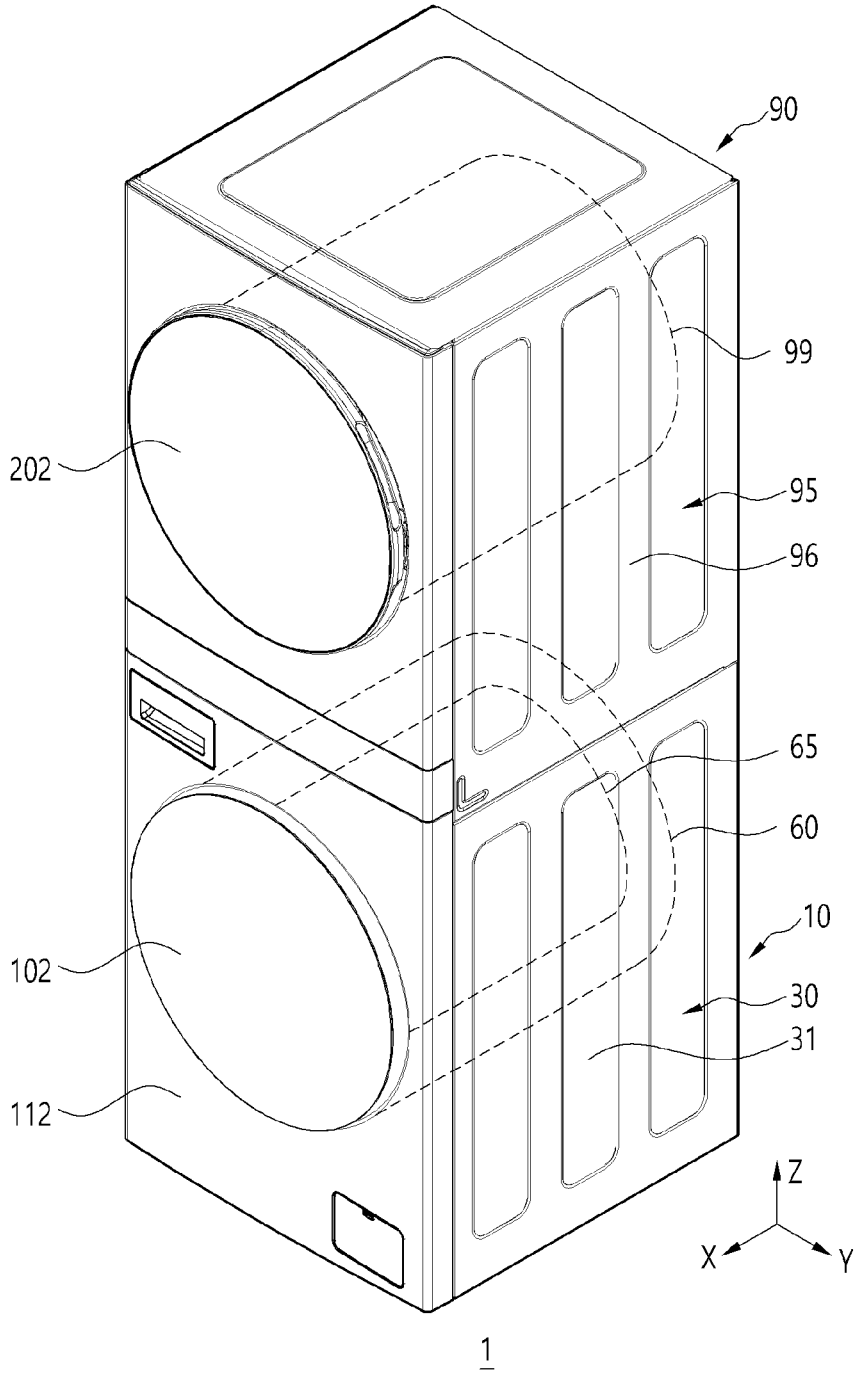
FIG. 3 is a perspective view of a laundry treating apparatus including an additional treating device according to an embodiment of the present disclosure.

FIG. 3 illustrates the laundry treating apparatus 1 including an additional treating device 90 according to an embodiment of the present disclosure. An embodiment of the present disclosure may include the additional treating device 90 including an additional cabinet 95 and an additional drum 99 in addition to the cabinet 10 and the components therein described above, as needed.

In the case of including the additional treating device 90, for convenience of explanation, the processing device including the cabinet 10 and the components therein may be defined as a basic treating device.

That is, an embodiment of the present disclosure may include the basic treating device and the additional treating device 90 that may independently perform a processing process of laundry, the basic treating device may include the cabinet 10 and the drum 60 described above, and the additional treating device 90 may include the additional cabinet 95 and the additional drum 99 that are distinct from the basic treating device.

The basic treating device and the additional treating device 90 may be arranged adjacent to each other to improve usability. For example, an embodiment of the present disclosure may be provided in a form in which the basic treating device and the additional treating device 90 are stacked in upward and downward directions, as illustrated in FIG. 3.

Referring to FIG. 3, according to an embodiment of the present disclosure, the additional treating device 90 may be installed on the basic treating device. However, it is also possible to install the basic treating device on the additional treating device 90 as needed.

When the additional treating device 90 is installed on the basic treating device, the cabinet 10 of the basic treating device may support the additional cabinet 95 below the additional cabinet 95 of the additional treating device 90. In this case, an embodiment of the present disclosure may include a control panel 85 for simultaneously controlling operations of the basic treating device and the additional treating device 90.

The control panel 85 may be located in various locations and shapes, and FIG. 3 illustrates the control panel 85 provided between the front panel 20 of the cabinet 10 and an additional front panel of the additional cabinet 95 according to an embodiment of the present disclosure.

Figure 4:
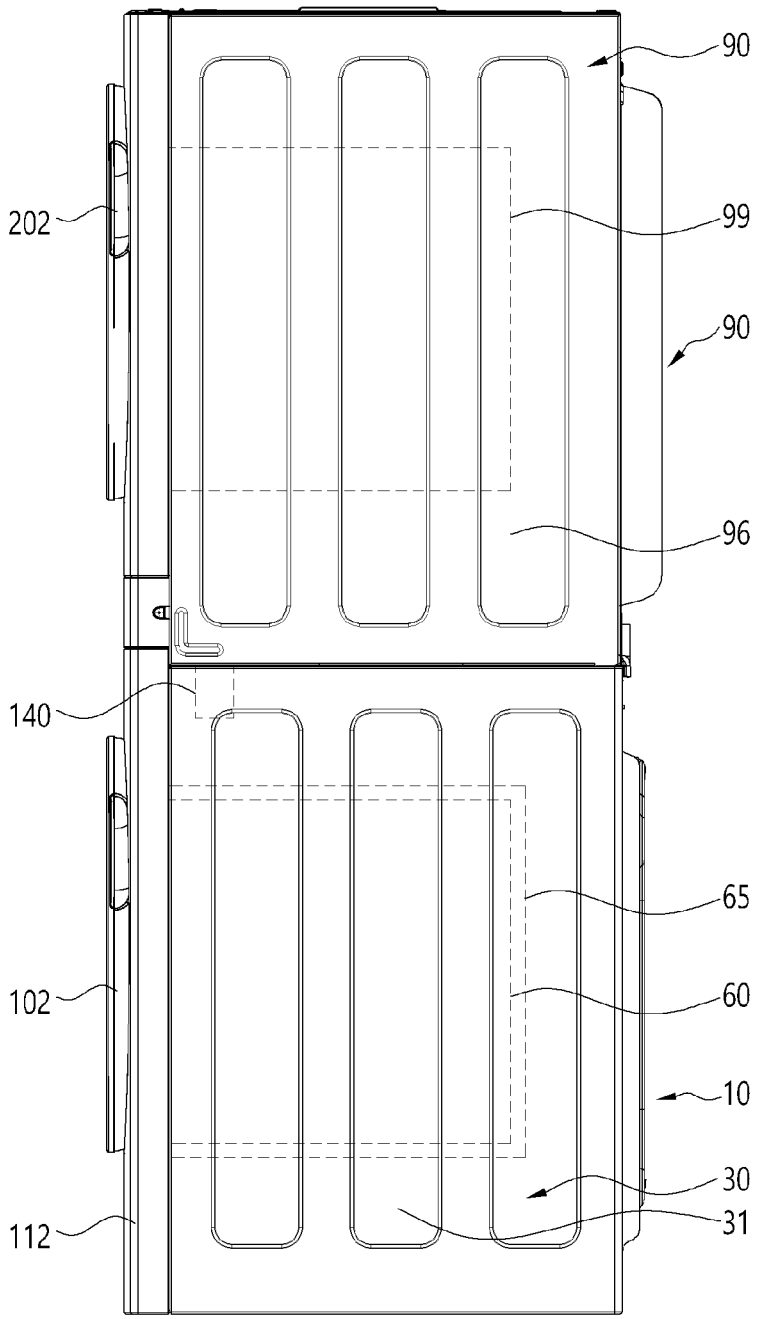
FIG. 4 is a side view of the laundry treating apparatus of FIG. 3.

FIG. 4 is a side view of the laundry treating apparatus 1 including the additional treating device 90 according to an embodiment of the present disclosure. In FIG. 4, the additional drum 99 of the additional treating device 90 and the tub 65 and drum 60 of the basic treating device are indicated in dotted lines.

Referring to FIG. 4, according to an embodiment of the present disclosure, the basic treating device and the additional treating device 90 may each be provided to perform a processing process for laundry, thereby providing a user with various processing processes for laundry.

For example, according to an embodiment of the present disclosure, the additional treating device 90 may include the additional drum 99 and the air supply unit to perform a drying process of laundry, and the basic treating device may include the drum 60 and the tub 65 to perform a washing process for laundry.

However, an embodiment of the present disclosure is not necessarily limited as described above, and the basic treating device may be provided to process either one of the drying process and the washing process of laundry, may be provided to process both the drying process and the washing process of laundry, and the additional treating device 90 may be provided to process either one of the drying process and the washing process of laundry or may be provided to process both the drying process and the washing process of laundry.

Figure 5:
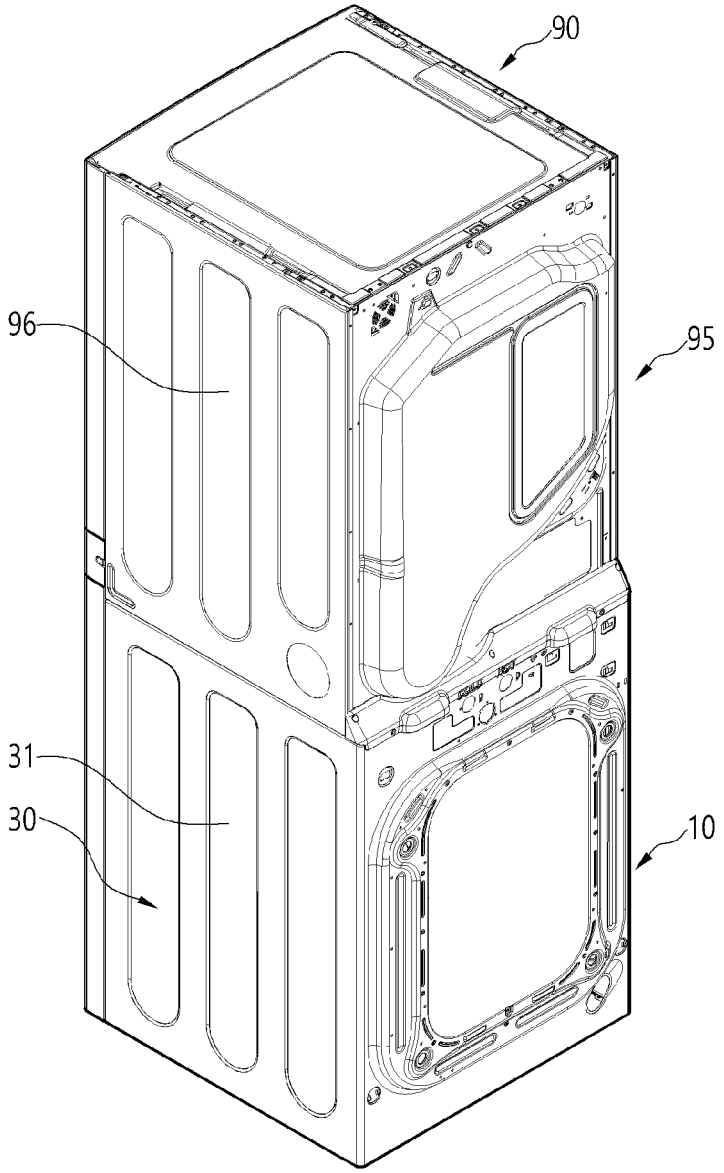
FIG. 5 is a perspective view showing a rear surface of the laundry treating apparatus of FIG. 3.

FIG. 5 is a perspective view; viewed from behind, of the laundry treating apparatus 1 including the additional treating device 90 according to an embodiment of the present disclosure. According to an embodiment of the present disclosure, rear surfaces of the cabinet 10 and the additional cabinet 95 may be coupled to each other through a rear bracket.

The additional cabinet 95 of the additional treating device 90 located on the basic treating device may be provided with a grip portion to be held by a user to facilitate movement of the cabinet 10, and the grip portion may be located at a rear side of the cabinet 10.

The grip portion may be connected to the top panel and the rear panel together and separated into an upper part connected to the top panel and a lower part connected to the rear panel to facilitate separation of the top panel for maintenance and management of the additional treating device 90.

Figure 6:
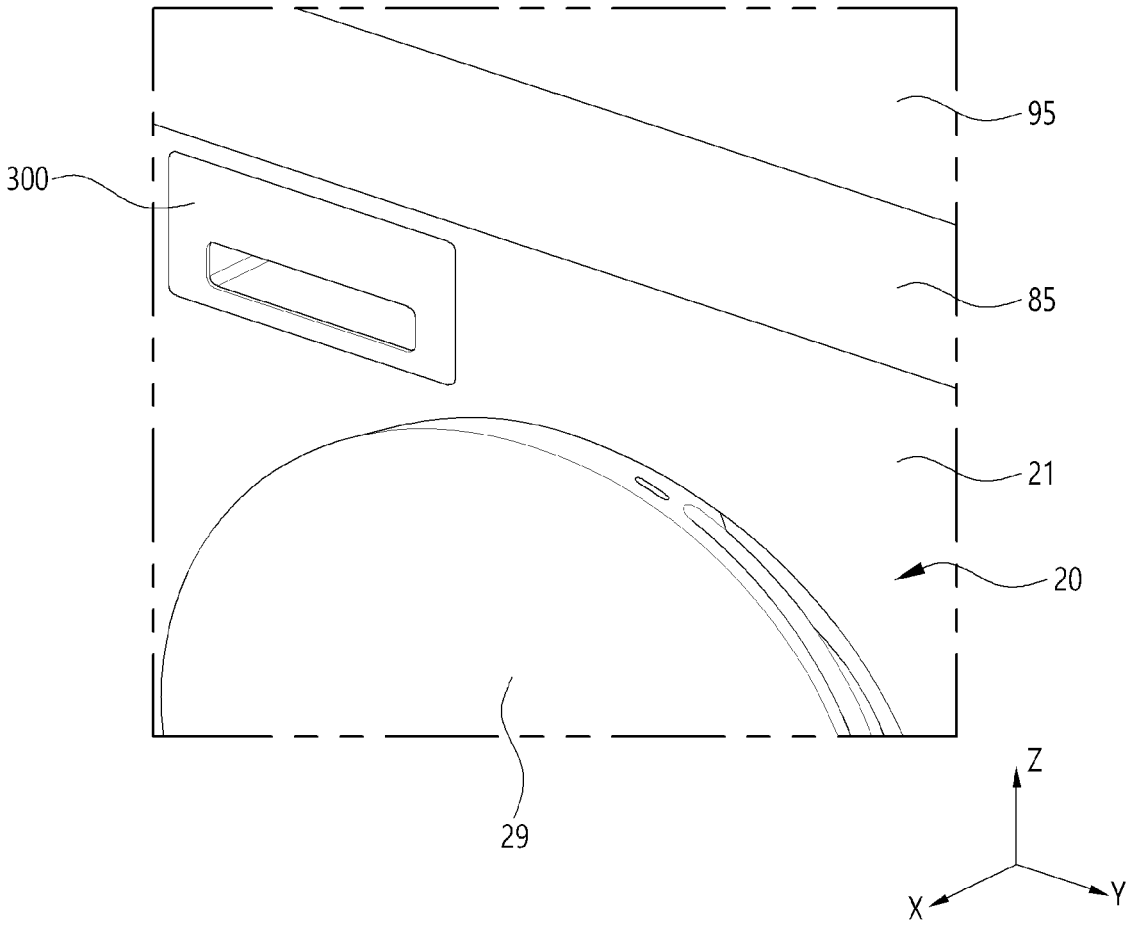
FIG. 6 is a drawing showing a detergent opening and storage unit provided on a front panel according to an embodiment of the present disclosure.

FIG. 6 illustrates a detergent opening 100 and a storage unit 300 inserted into the detergent opening 100 of the laundry treating apparatus 1 provided to perform a washing process of laundry according to an embodiment of the present disclosure.

Hereinafter, a description will be given based on the laundry treating apparatus 1 for performing a washing process of laundry according to an embodiment of the present disclosure. The laundry treating apparatus 1 according to an embodiment of the present disclosure may include the cabinet 10, tub 65, drum 60, and detergent supply unit 72 described above.

The cabinet 10 may include the detergent opening 100. The detergent opening 100 may be provided in at least one of the various panels constituting the cabinet 10. For example, the detergent opening 100 may be provided above the front panel 20 as shown in FIG. 6.

A user may supply detergent into the cabinet 10 through the detergent opening 100. For example, the user may store detergent in the storage unit 300 to be described later and insert the storage unit 300 in which the detergent is stored into the cabinet 10 through the detergent opening 100 to supply detergent into the cabinet 10.

That is, according to an embodiment of the present disclosure, the detergent opening 100 may correspond to a passage through which the storage unit 300 is inserted into the cabinet 10 and have a cross-sectional shape corresponding to the storage unit 300.

The tub 65 may be provided inside the cabinet 10, may accommodate water, and may receive detergent from the detergent supply unit 72. A space for washing laundry may be formed inside the tub 65.

The drum 60 may be provided inside the tub 65 and may accommodate laundry. Water and detergent contained inside the tub 65 may be shared inside the drum 60, and the drum 60 may be rotated by the driver 70 or the like to perform the washing process of laundry.

Figure 7:
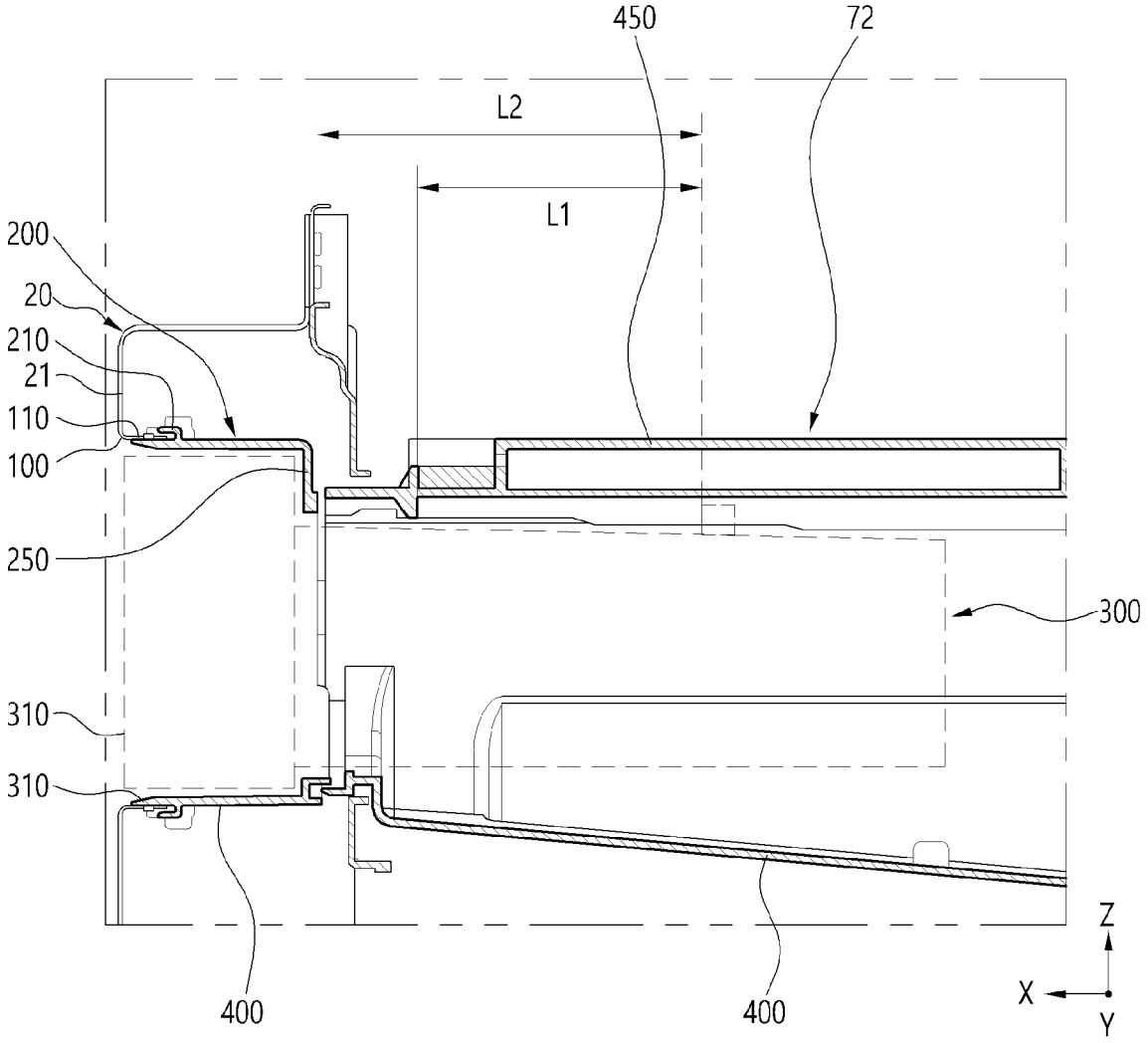
FIG. 7 is a cross-sectional view showing a retract case and a detergent case viewed from a lateral direction according to an embodiment of the present disclosure.

FIG. 7 illustrates the detergent supply unit 72 provided inside the cabinet 10. In detail, the detergent supply unit 72 may be provided inside the cabinet 10 to supply detergent into the tub 65.

The detergent supply unit 72 may define a space in which the storage unit 300 is accommodated inside the cabinet 10. For example, the detergent supply unit 72 may include a detergent case 400 that defines an accommodation space 470 in which the storage unit 300 is accommodated. In FIG. 7, the storage unit 300 at least partially accommodated inside the detergent case 400 according to an embodiment of the present disclosure is indicated by dotted lines.

The detergent supply unit 72 may include a water supply unit 450 for supplying water into the storage unit 300 and/or the detergent case 400 and include a retract case 200 located between the detergent case 400 and the detergent opening 100. A detailed description of the retract case 200 and the water supply unit 450 will be described below.

Figure 8:
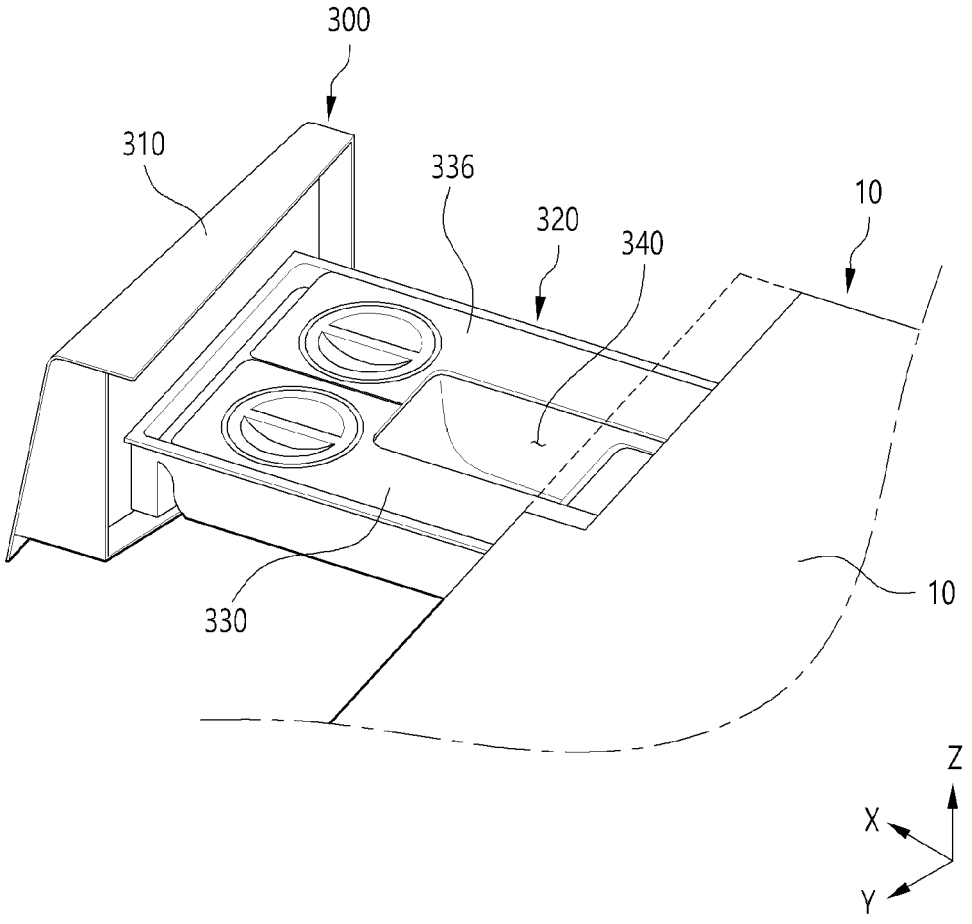
FIG. 8 is a drawing showing a storage unit extended out of a cabinet according to an embodiment of the present disclosure.

FIG. 8 illustrates the storage unit 300 extended out of the cabinet 10. The storage unit 300 may be retracted or extended into or out of the cabinet 10 through the detergent opening 100. A user may store detergent in the storage unit 300 extended out of the cabinet 10.

The storage unit 300 may include a space in which detergent is stored. For example, as illustrated in FIG. 8, the storage unit 300 may include a storage tank 330 in which liquid detergent and the like are to be stored and include a storage case 320 including a space into which the storage container 330 is inserted.

The storage unit 300 may include a detergent storage space 340 separate from the storage tank 330. In the storage space 340 provided in the storage case 320, detergent that is distinguished from the storage tank 330 may be stored by the user. The detergent stored in the storage tank 330 may be discharged from the storage unit 300 together with the water supplied from the water supply unit 450 and introduced into the detergent case 400.

The storage unit 300 may include a handle portion 310 to facilitate retraction and extension by the user. The handle portion 310 may be provided at a front end of the storage case 320. The handle portion 310 may be exposed to the outside when the storage unit 300 is retracted into the cabinet 10.

For example, the storage unit 300 may be retracted into the cabinet 10 through the detergent opening 100 of the front panel 20, and the handle portion 310 to be located at the front end of the storage unit 300 may be exposed to a front side of the cabinet 10. The handle portion 310 may be located in front of the detergent opening 100 and may define a portion of the front surface of the cabinet 10.

Figure 9:
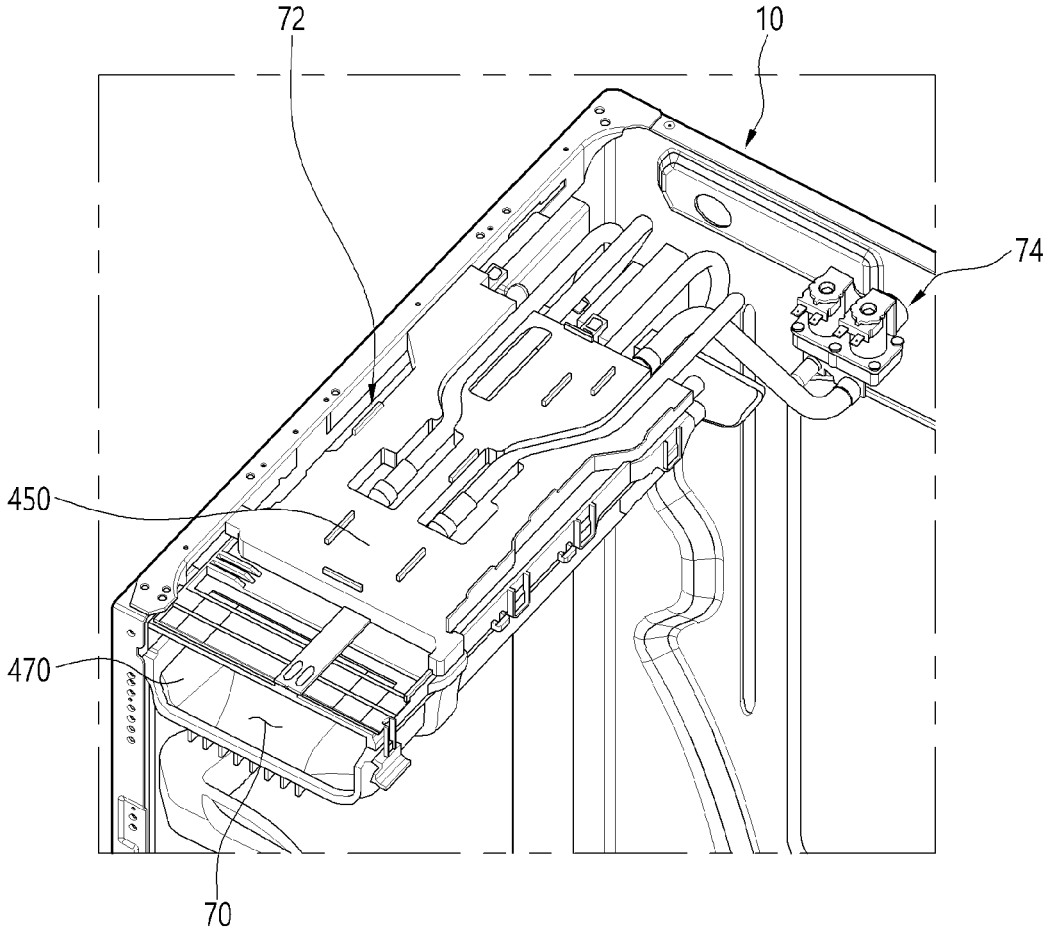
FIG. 9 is a perspective view showing a detergent supply unit located inside a cabinet according to an embodiment of the present disclosure.

FIG. 9 illustrates the detergent supply unit 72 installed inside the cabinet 10. According to an embodiment of the present disclosure, the detergent supply unit 72 may be positioned with the water supply unit 450 located above the detergent case 400 with an open upper surface, as shown in FIG. 9.

That is, the water supply unit 450 may define an upper surface of the detergent case 400 and supply water into the detergent case 400. The water supply unit 450 and the detergent case 400 may be opened forward together to define the accommodation space 470 in which the storage unit 300 is accommodated.

The detergent case 400 and the water supply unit 450 may be located behind the retract case 200, and the detergent case 400 may define a combined relationship with the retract case 200. The storage unit 300 may be accommodated inside the detergent case 400 to pass through the detergent opening 100 and the retract case 200.

The water supply unit 450 may be connected to the water supply unit 74. That is, water supplied from the water supply unit 74 may be supplied into the detergent case 400 through the water supply unit 450. The water supply unit 450 may be provided to receive detergent flowing out from the storage unit 300 as needed.

For example, the detergent case 400 may include a detergent pump, and the detergent pump may be connected to the storage unit 300 to pump detergent stored in the storage unit 300 to the water supply unit 450 through a detergent hose.

Figure 10:
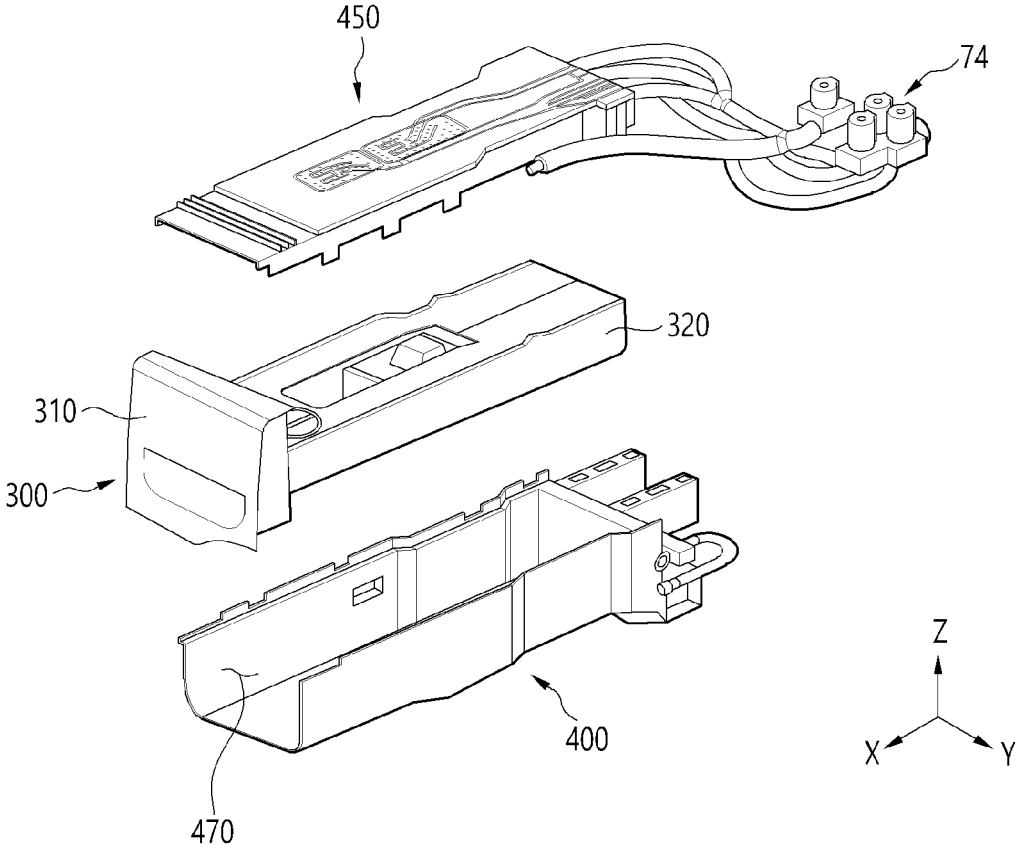
FIG. 10 is an exploded perspective view showing the configuration of a detergent supply unit according to an embodiment of the present disclosure.

FIG. 10 illustrates an exploded view of components of the detergent supply unit 72 according to an embodiment of the present disclosure. FIG. 10 illustrates the water supply unit 450, the storage unit 300, and the detergent case 400.

Water discharged from the water supply unit 450 may be discharged toward the inside of the detergent case 400, and water provided from the water supply unit 450 may be delivered to the inside of the storage unit 300 and/or the detergent case 400.

The storage unit 300 may discharge detergent together with water supplied from the water supply unit 450. Water and detergent discharged from the storage unit 300 may flow into the accommodation space 470 defined inside the detergent case 400.

The detergent case 400 may be connected to the tub 65 and may supply water and detergent present in the accommodation space 470 to the tub 65. The controller described above may control the water supply unit 74 during the washing process of laundry to supply water to the water supply unit 450, discharge water and detergent provided from the water supply unit 450 together from the detergent case 400 and supply the water and detergent to the tub 65, and thus may perform the washing process of laundry.

Figure 11:
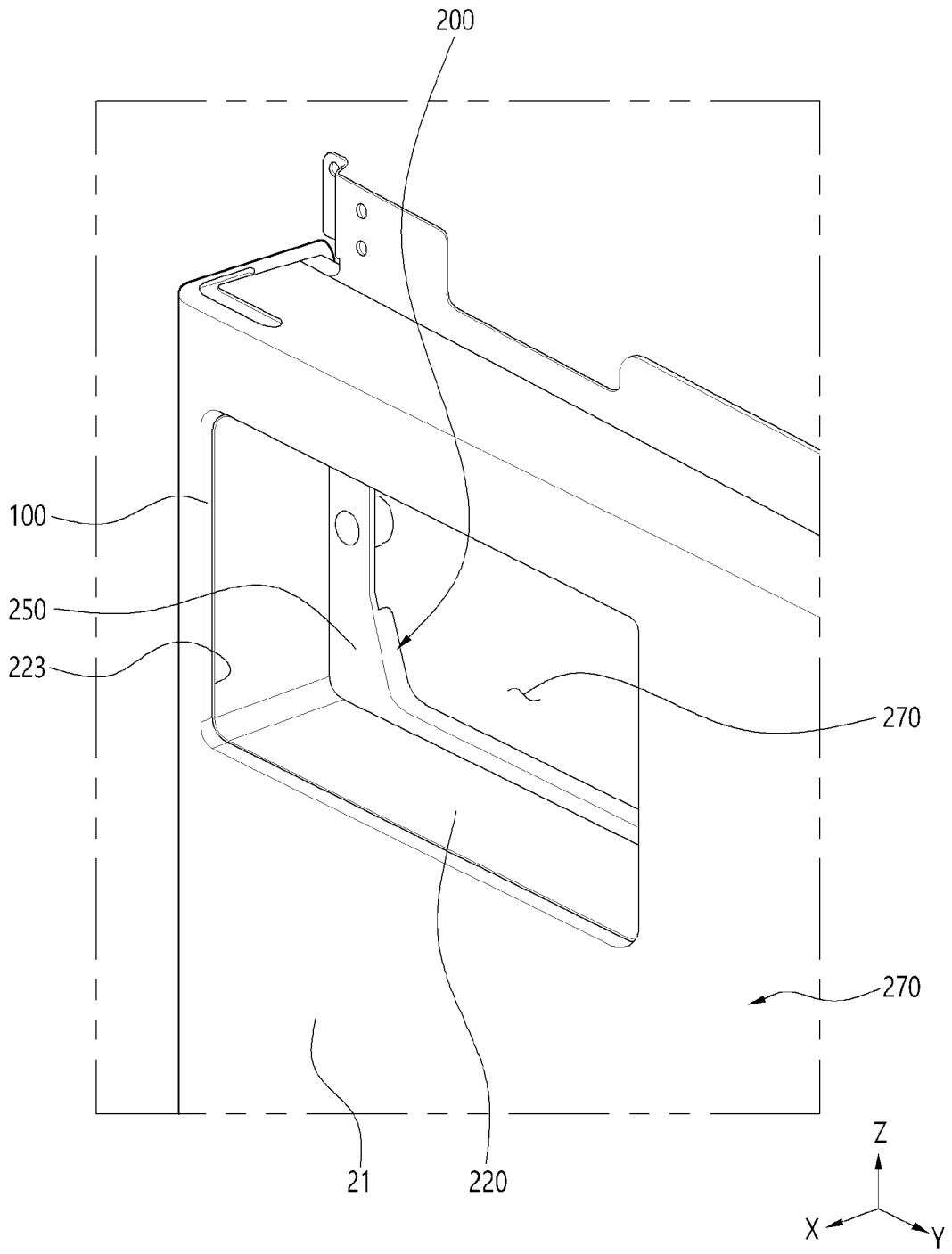
FIG. 11 is a diagram showing a retract case combined with a detergent opening according to an embodiment of the present disclosure.
Figure 12:
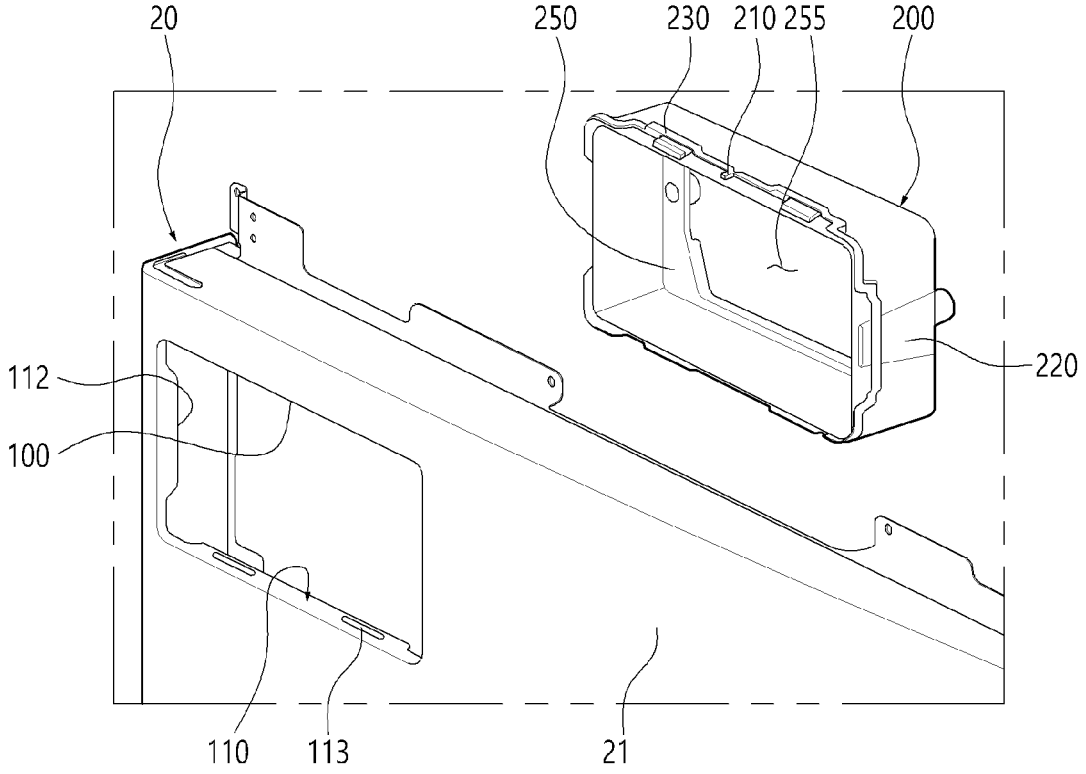
FIG. 12 is a diagram showing a retract case separated from a detergent opening according to an embodiment of the present disclosure.

FIG. 11 illustrates the retract case 200 coupled to the detergent opening 100, and FIG. 12 illustrates the retract case 200 separated from the detergent opening 100.

According to an embodiment of the present disclosure, the retract case 200 may be coupled to the detergent opening 100. The retract case 200 may be coupled to the front panel 20 at a rear side of the front panel 20 and located in the detergent opening 100.

An opening periphery 110 may be provided around the detergent opening 100. The opening periphery 110 may define a closed cross-section extending along a periphery of the detergent opening 100. The opening periphery 110 may extend rearward from the front panel 20. The opening periphery 110 may be formed by bending backward from the periphery of the detergent opening 100.

The retract case 200 may be provided to surround the detergent opening 100 inside the detergent opening 100. That is, the storage unit 300 retracted through the detergent opening 100 may be inserted into the cabinet 10 to pass through the retract case 200.

The retract case 200 may be located between the detergent opening 100 and the storage unit 300 to prevent the storage unit 300 from being in direct contact with the detergent opening 100. That is, the retract case 200 may be provided to cover the detergent opening 100 from the storage unit 300.

The storage unit 300 may include a space in which detergent is stored and may undergo a movement process of being extended or retracted from or into the cabinet 10. During the movement process of the storage unit 300, detergent remaining outside the storage unit 300 or detergent stored in the storage unit 300 may unintentionally leak and be transferred to the periphery of the detergent opening 100.

The detergent opening 100 may be provided on the front panel 20, and the front panel 20 may be manufactured through forming a metal plate such as iron. That is, the metal forming at least a portion of the front panel 20 may corrode when coming into contact with detergent, which may reduce the durability of the front panel 20.

To prevent this, an embodiment of the present disclosure may be provided with the retract case 200 coupled to the detergent opening 100. The retract case 200 may include a material that is resistant to corrosion by detergent, such as plastic.

The retract case 200 may effectively prevent detergent present in the storage unit 300 from coming into contact with the opening periphery 110 or the like by shielding the front panel 20 or the opening periphery 110 corresponding to the periphery of the detergent opening 100 from the storage unit 300, and further prevent a surface layer of the opening periphery 110 having a coating function from being damaged during the movement process of the storage unit 300.

Figure 13:
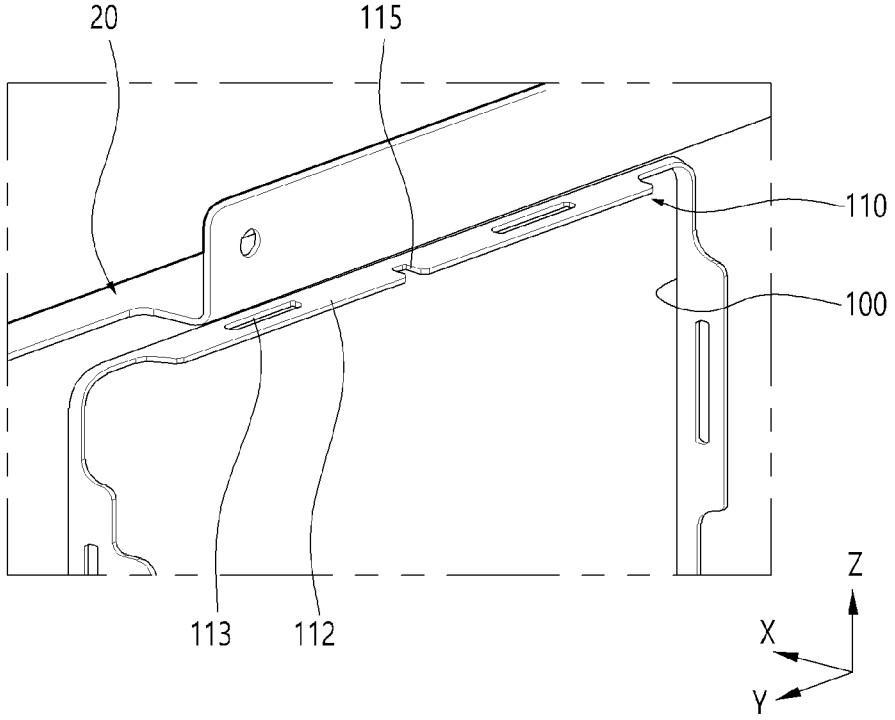
FIG. 13 is a diagram showing an opening periphery provided on a front panel according to an embodiment of the present disclosure.

FIG. 13 illustrates the opening periphery 110 protruding rearwardly from the front panel 20 according to an embodiment of the present disclosure. According to an embodiment of the present disclosure, the opening periphery 110 may extend along the periphery of the detergent opening 100 and protrude into the cabinet 10.

The opening periphery 110 may correspond to a flange that surrounds the detergent opening 100 and faces the inside of the cabinet 10. The opening periphery 110 may be formed to protrude toward a rear side of the cabinet 10 during a punching process of the front panel 20 to form the detergent opening 100.

The opening periphery 110 may include a basic extension that extends rearwardly from the detergent opening 100, and an opening extension 112 that extends further rearwardly from the basic extension. The opening periphery 110 may face the retract case 200 and may be coupled to the retract case 200.

Figure 14:
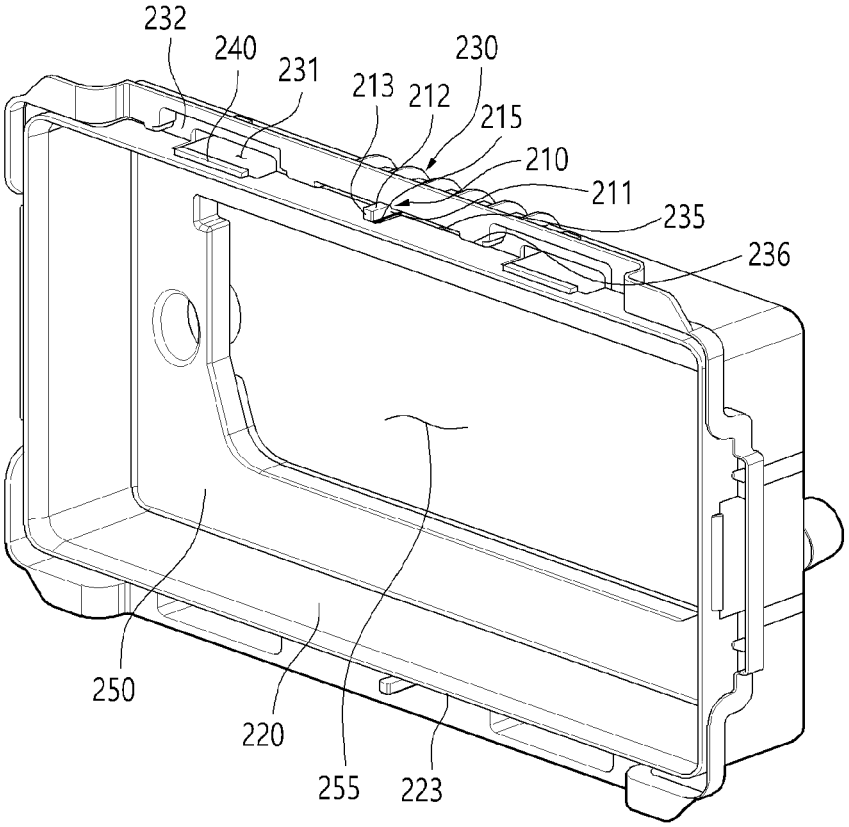
FIG. 14 is a perspective view showing a retract case according to an embodiment of the present disclosure.

FIG. 14 illustrates the retract case 200 according to an embodiment of the present disclosure. Referring to FIG. 14, the retract case 200 may be combined with the opening periphery 110 inside the cabinet 10.

The retract case 200 may accommodate at least a portion of the storage unit 300 retracted into the cabinet 10. For reference, FIG. 7 shows the storage unit 300 that is accommodated inside the cabinet 10 and a portion of which is accommodated inside the retract case 200 as indicated by dotted lines.

The retract case 200 may include an internal partition 250 formed to pass through the storage unit 300. The internal partition 250 may be provided approximately parallel to the front panel 20 and may face the accommodation space 470 of the detergent case 400.

A through hole 255 through which the storage unit 300 passes may be provided in the internal partition 250. The storage unit 300 may pass through the through hole 255 and may be inserted into the accommodation space 470 of the detergent case 400.

The retract case 200 may include a protruding joint 210. The protruding joint 210 may extend toward the opening periphery 110, and may have a first insertion groove 215 that is formed at a portion facing the opening periphery 110 and recessed away from the opening periphery 110.

Referring to FIG. 14, the protruding joint 210 may extend from the retract case 200 toward the opening periphery 110. The protruding joint 210 may protrude away from the through hole 255 in the retract case 200.

That is, the protruding joint 210 may protrude from the retract case 200 toward the outside of the retract case 200. The protruding joint 210 may protrude in a direction away from the storage unit 300.

The first insertion groove 215 for inserting the opening periphery 110 may be formed in the protruding joint 210. The first insertion groove 215 may be formed at a location of the protruding joint 210, which faces the opening periphery 110.

Accordingly, when the retract case 200 approaches the detergent opening 100 from the rear side of the front panel 20, the opening periphery 110 may be inserted into the first insertion groove 215 of the protruding joint 210.

The opening periphery 110 may have a second insertion groove 115 that is formed in a portion facing the first insertion groove 215 to be recessed away from the protruding joint 210. That is, the opening periphery 110 may have the second insertion groove 115 that is formed in a portion of the protruding joint 210 or the first insertion groove 215.

The second insertion groove 115 may be formed by recessing a portion of the opening periphery 110 away from the protruding joint 210. The second insertion groove 115 may be formed by recessing a portion of the opening periphery 110 forward. For reference, FIG. 13 illustrates a second insertion groove (115) formed in the opening periphery 110.

Figure 15:
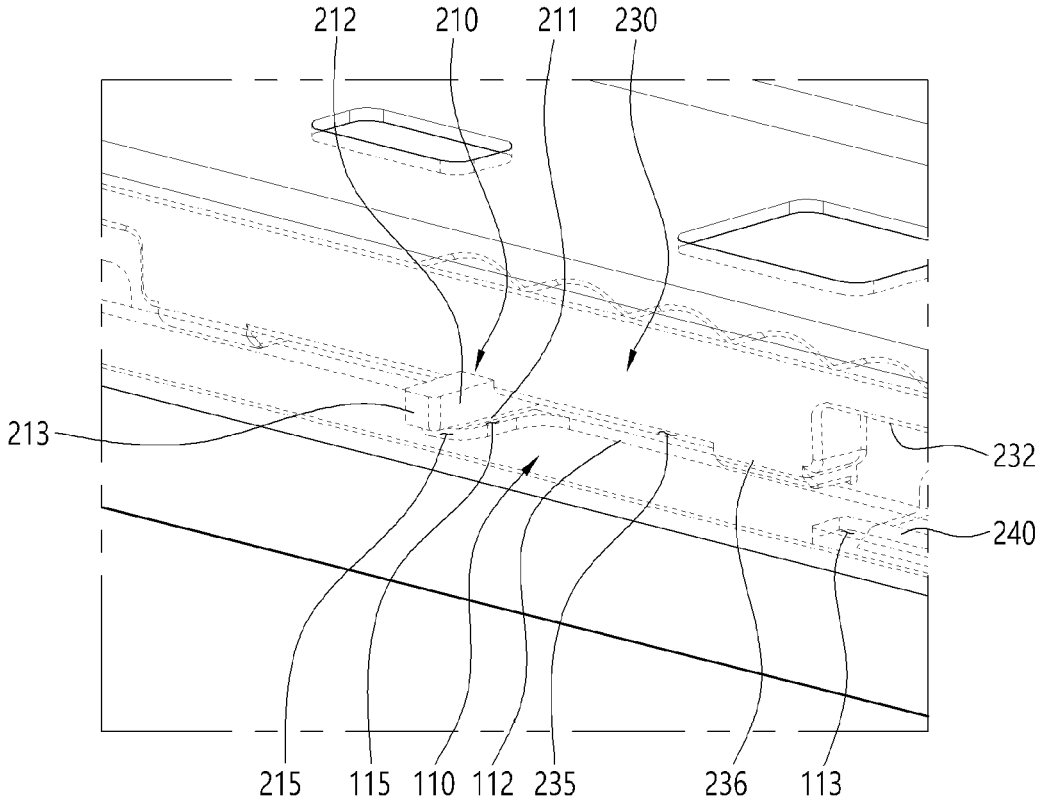
FIG. 15 is a diagram showing a state in which a retract case and an opening periphery are combined with each other according to an embodiment of the present disclosure.
Figure 16:
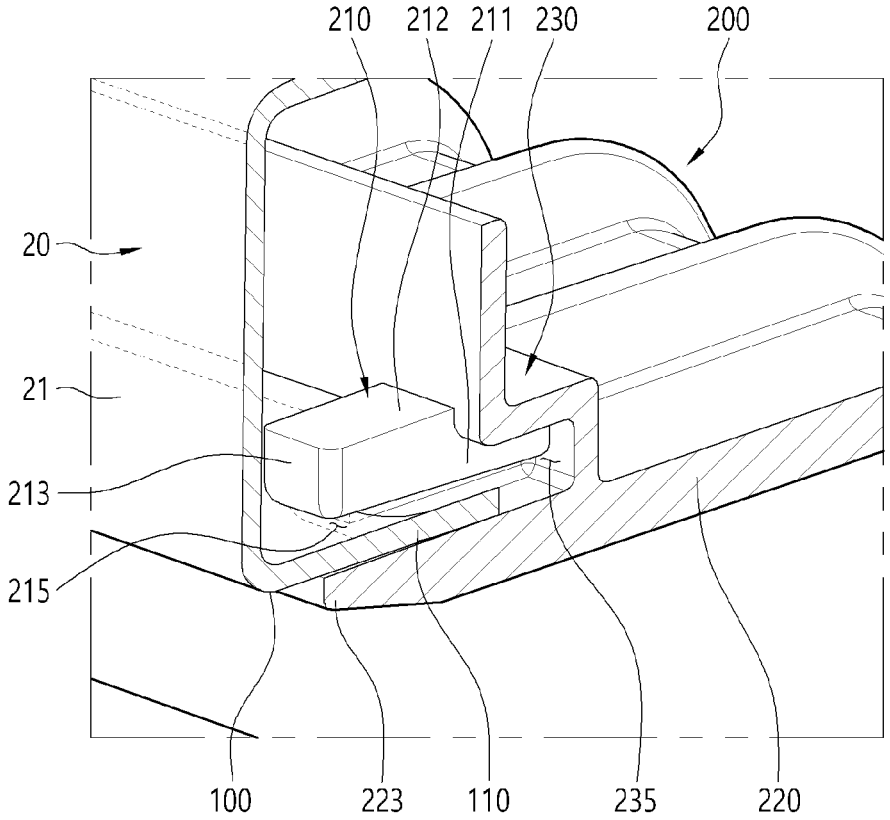
FIG. 16 is a diagram showing a protruding joint combined with an opening periphery according to an embodiment of the present disclosure.

FIG. 15 illustrates a state in which the retract case 200 and the opening periphery 110 are combined with each other, and FIG. 16 illustrates an enlarged view of a state in which the protruding joint 210 and the opening periphery 110 are combined with each other.

Referring to FIGS. 15 and 16, according to an embodiment of the present disclosure, the protruding joint 210 may be inserted into the second insertion groove 115 while the opening periphery 110 is inserted into the first insertion groove 215.

The retract case 200 may be moved from the rear side of the detergent opening 100 toward the detergent opening 100 and combined with the opening periphery 110. In the process of combining the retract case 200 and the opening periphery 110, the opening periphery 110 may be inserted into the first insertion groove 215 formed in the protruding joint 210 of the retract case 200, and at least a portion of the protruding joint 210 may be inserted into the second insertion groove 115 formed on the opening periphery 110.

In other words, a portion of the second insertion groove 115 of the opening periphery 110 may be inserted into the first insertion groove 215 of the retract case 200, and a portion of the protruding joint 210, in which the first insertion groove 215 is formed, may be inserted into the second insertion groove 115 of the opening periphery 110.

As described above, the opening periphery 110 extending along a periphery of the detergent opening 100 may be inserted into the first insertion groove 215 of the retract case 200, and thus at least a periphery of the first insertion groove 215 in the retract case 200 may be prevented from moving or deforming to move away from or close to the detergent opening 100.

For example, as shown in FIGS. 13 to 15, when the protruding joint 210 and the first insertion groove 215 are provided on an upper surface of the retract case 200 and the second insertion groove 115 is formed above the detergent opening 100 of the opening periphery 110, the upper surface of the retract case 200 may be effectively prevented from sagging by inserting the opening periphery 110 into the first insertion groove 215.

According to an embodiment of the present disclosure, the second insertion groove 115 into which at least a portion of the protruding joint 210 is inserted may be provided in the opening periphery 110, and thus a combined location of the protruding joint 210 may be effectively guided.

For example, when the protruding joint 210 of the retract case 200 is not inserted into the second insertion groove 115, insertion of the opening periphery 110 for combining may not be completely completed, and therefore, alignment of the protruding joint 210 and the second insertion groove 115 may be effectively confirmed during the combining process of the retract case 200.

As the protruding joint 210 is inserted into the second insertion groove 115 formed in the opening periphery 110 extending along the periphery of the detergent opening 100, at least a portion of the retract case 200, in which the protruding joint 210 is provided, may be restricted from moving in a periphery direction of the detergent opening 100.

That is, according to an embodiment of the present disclosure, a combining position of the retract case 200 to be combined with the opening periphery 110 by the second insertion groove 115 of the opening periphery 110 may be effectively identified, and unintended movement or deformation of the retract case 200 along the periphery direction of the detergent opening 100 may be effectively prevented.

According to an embodiment of the present disclosure, the opening periphery 110 may be combined with the protruding joint 210 and the first insertion groove 215 of the retract case 200, thereby effectively preventing deformation in which a portion of the retract case 200 sags or a distance from the detergent opening 100 changes, and the protruding joint 210 may be inserted into the second insertion groove 115 of the opening periphery 110, thereby conveniently guiding the combining position of the retract case 200 and improving the combining position of the retract case 200.

As described above, the protruding joint 210 may protrude away from the storage unit 300 in the retract case 200. A portion of the opening periphery 110, which extends in a direction crossing a protruding direction of the protruding joint 210, may include the second insertion groove 115 and may be inserted into the first insertion groove 215.

The protruding joint 210 may protrude in a direction away from the detergent opening 100 or the through hole 255 in the retract case 200, and the opening periphery 110 and the first insertion groove 215 may be provided to cross the protruding direction of the protruding joint 210, thereby effectively preventing the retract case 200 from being deformed or moved in the protruding direction of the protruding joint 210.

The second insertion groove 115 may be provided to face the protruding joint 210, and thus the opening periphery 110 may be inserted into the first insertion groove 215 of the protruding joint 210, and at the same time, the protruding joint 210 may be inserted into the second insertion groove 115 facing the protruding joint 210. For reference, FIG. 16 illustrates the protruding joint 210, the first insertion groove 215, and the second insertion groove 115 protruding from the retract case 200.

The protruding joint 210 may be provided in plural and spaced apart along the periphery of the detergent opening 100. Each protruding joint 210 may include the first insertion groove 215 into which the opening periphery 110 is inserted, and accordingly, a plurality of portions of the retract case 200 may be prevented from being deformed in the protruding direction of the protruding joint 210.

As described above, the detergent opening 100 may be formed in the front panel 20 of the cabinet 10, and the storage unit 300 may be retracted into the cabinet 10 rearwardly through the detergent opening 100.

The protruding joint 210 may protrude upward from the retract case 200, a portion of the opening periphery 110, which is located above the detergent opening 100 and extends in a lateral direction may include the second insertion groove 115, and the opening periphery 110 may be inserted into the first insertion groove 215. Accordingly, the upper surface of the retract case 200 may be effectively prevented from sagging downward.

As shown in FIG. 16, a portion of the protruding joint 210, which is located behind the first insertion groove 215, may be inserted into the second insertion groove 115, and a portion of the opening periphery 110, which is located in front of the second insertion groove 115, may be inserted into the first insertion groove 215.

In detail, the first insertion groove 215 may be provided in the protruding joint 210, and a portion of the protruding joint 210, which faces the second insertion groove 115, may be recessed rearward to form the first insertion groove 215, and thus a portion of the opening periphery 110, which is located in front of the second insertion groove 115, may be inserted into the first insertion groove 215.

A portion of the opening periphery 110, which faces the first insertion groove 215, may be recessed forward, and thus a portion of the protruding joint 210, which is located behind the first insertion groove 215, may be inserted into the second insertion groove 115.

That is, the first insertion groove 215 and the second insertion groove 115 may be formed facing each other, and thus the opening periphery 110 and the protruding joint 210 may have an insertion relationship at the same time, the opening periphery 110 may be inserted into the first insertion groove 215 while passing the second insertion groove 115, and the protruding joint 210 may be inserted into the second insertion groove 115 while passing the first insertion groove 215.

The first insertion groove 215 and the second insertion groove 115 may be formed in directions that intersect with each other in consideration of an extension direction of the opening periphery 110 and a protrusion direction of the protruding joint 210. That is, the first insertion groove 215 and the second insertion groove 115 may be formed in a direction crossing each other.

That is, width directions of the first insertion groove 215 and the second insertion groove 115 may be formed to cross each other. The first insertion groove 215 may be opened in a periphery direction of the detergent opening 100 such that the opening periphery 110 is to be inserted, and the second insertion groove 115 may be opened in the protruding direction of the protruding joint 210 such that the protruding joint 210 is to be inserted. That is, an opening direction of the first insertion groove 215 may cross an opening direction of the second insertion groove 115.

The retract case 200 may include a case periphery 220. The case periphery 220 may be provided to surround at least a portion of the storage unit 300. The case periphery 220 may extend along the periphery of the retract case 200 or the periphery of the detergent opening 100, and a portion of the storage unit 300, which is accommodated in the retract case 200, may be surrounded by the case periphery 220.

The case periphery 220 may be provided to cover the opening periphery 110 described above inside the detergent opening 100, and thus may be located between the storage unit 300 and the opening periphery 110. A front end 223 of the case periphery 220 may be surrounded by the opening periphery 110 inside the opening periphery 110.

For reference, FIG. 11 illustrates the case periphery 220 covering the opening periphery 110 in the retract case 200. The case periphery 220 may be to cover the opening periphery 110 and may block contact between the storage unit 300 and the opening periphery 110 and prevent detergent from coming into contact with the opening periphery 110.

The retract case 200 may include a periphery joint 230 that protrudes from the case periphery 220 and into which the opening periphery 110 is inserted from a front side. The periphery joint 230 may protrude outside the detergent opening 100 in the retract case 200.

The periphery joint 230 may protrude away from the inside of the retract case 200. The periphery joint 230 may protrude from the case periphery 220 of the retract case 200. The opening periphery 110 may be inserted into the periphery joint 230 as shown in FIG. 15.

The periphery joint 230 may be provided on an entire periphery of the retract case 200 or at least on a portion of the periphery. The opening periphery 110 may be inserted into and combined with the periphery joint 230 from the front side, and thus the retract case 200 may be effectively fixed to the rear side of the detergent opening 100.

The front end of the protruding joint 210, that is, a front end 213 of a front protrusion 212 may be located further forward than the periphery joint 230. That is, the protruding joint 210 may be combined with the opening periphery 110 in front of the periphery joint 230.

Accordingly, deformation such as sagging of the case periphery 220 may be effectively prevented from occurring in a portion of the case periphery 220, which is located further forward than the periphery joint 230.

The protruding joint 210 may be inserted into the second insertion groove 115 before the opening periphery 110 is inserted into the periphery joint 230, and thus it is possible to check whether the combining position of the retract case 200 is normal before the opening periphery 110 and the periphery joint 230 are combined with each other.

Referring back to FIG. 16, the protruding joint 210 may include a body portion 211 and the front protrusion 212. The body portion 211 may protrude outwardly from the case periphery 220, the front protrusion 212 may extend forwardly from the body portion 211, and the first insertion groove 215 may be formed between the body portion 211 and the case periphery 220.

In detail, the body portion 211 of the protruding joint 210 may extend outward from the case periphery 220, and the front protrusion 212 may be provided on the body portion 211 to be spaced apart from the case periphery 220.

Accordingly, a space may be formed between the front protrusion 212 and the case periphery 220 in front of the body portion 211, and the space may correspond to the first insertion groove 215. The first insertion groove 215 may also extend along the periphery of the body portion 211.

For example, the front protrusion 212 may extend forward from the body portion 211 and at the same time protrude laterally from the body portion 211, and thus the first insertion groove 215 formed between the front protrusion 212 and the case periphery 220 may be located to extend not only forward but also laterally of the body portion 211.

Referring back to FIG. 14, the retract case 200 may further include a through joint 240. The through joint 240 may protrude outwardly from the case periphery 220 and pass through the opening periphery 110.

As described above, the case periphery 220 may be provided to surround the detergent opening 100 inside the opening periphery 110. That is, the through joint 240 protruding outward from the case periphery 220 may pass through the opening periphery 110.

In a state in which the opening periphery 110 and the retract case 200 are combined with each other by the first insertion groove 215 and the second insertion groove 115 and the opening periphery 110 is inserted into the periphery joint 230, the retract case 200 may be effectively prevented from moving rearward and being separated from the opening periphery 110 by forming the through joint 240 to pass through the opening periphery 110.

The through joint 240 may have a rib shape that extends in a periphery direction of the detergent opening 100, and thus a contact area between the through joint 240 and the opening periphery 110 may increase based on a combining direction of the retract case 200, thereby increasing a separation prevention effect of the retract case 200.

The through joint 240 may be provided in plural, the plurality of through joints 240 may be spaced apart from each other in the periphery direction, and the protruding joint 210 may be located between any one pair of through joints 240 from among the plurality of through joints 240.

FIG. 14 illustrates a pair of through joints 240 protruding upward from the retract case 200 and illustrates a state in which the protruding joint 210 protrudes upward between the pair of through joints 240. Sagging of the case periphery 220 between the pair of through joints 240 may be effectively prevented by the protruding joint 210.

The through joint 240 may be located in front of the periphery joint 230, and a portion of the opening periphery 110, which is located behind the through joint 240, may be inserted into the periphery joint 230.

A coupling hole 113 penetrated by the through joint 240 may be provided in the opening periphery 110. That is, the through joint 240 may be located within the coupling hole 113. The cross-sectional shape of the coupling hole 113 may correspond to the through joint 240.

The coupling hole 113 may be spaced forward from a rear end of the opening periphery 110. Accordingly, the rear end of the opening periphery 110 may be inserted into the periphery joint 230 while the through joint 240 is inserted into the coupling hole 113.

In a process of combining the retract case 200, the rear side of the coupling hole 113 in the opening periphery 110 may pass the through joint 240 and may be inserted into the periphery joint 230. Accordingly, combination between the opening periphery 110 and the through joint 240 and combination between the opening periphery 110 and the periphery joint 230 may be performed together in front and rear directions.

An open hole 231 formed to pass through the periphery joint 230 may be formed behind a portion of the periphery joint 230, in front of which the through joint 240 is located. The open hole 231 may be formed to pass the periphery joint 230 in front and rear directions.

The coupling hole 113 and the through joint 240 may be located in front of the open hole 231. The rear end of the opening periphery 110 passing the rear side of the through joint 240 may be located inside or in front of the open hole 231.

The open hole 231 may be diverse. For example, as illustrated in FIG. 14, the width of the open hole 231 may be larger than the width of the through joint 240. The height of the open hole 231 may also be equal to or greater than that of the through joint 240. However, the width and height of the open hole 231 may be changed in various ways as needed.

As described above, the retract case 200 may be moved from the rear side to the front side of the detergent opening 100 and combined with the opening periphery 110. When the retract case 200 moves, the opening periphery 110 may be inserted into the periphery joint 230, and the through joint 240 may be inserted into the coupling hole 113.

When the retract case 200 is to be separated from the detergent opening 100 or the opening periphery 110 for replacement or repair of the retract case 200, an operator may access the rear end of the opening periphery 110 through the open hole 231 from the rear side of the open hole 231.

That is, the operator may separate the retract case 200 by lifting the rear end of the opening periphery 110 from the case periphery 220 of the retract case 200 through the open hole 231 such that the coupling hole 113 is located above the through joint 240.

The periphery joint 230 may include a hole extension 232. The hole extension 232 may be formed on one surface of the periphery joint 230, which faces the detergent opening 100, and may be recessed rearward while surrounding the open hole 231.

In other words, the hole extension 232 of the periphery joint 230 may be located behind the through joint 240 and formed by recessing the front surface of the periphery joint 230 rearwardly. The depth of the hole extension 232 may vary.

For example, the depth of the hole extension 232 may be greater than the length of the opening periphery 110 inserted into the periphery joint 230. Accordingly, a portion of the opening periphery 110 inserted into the periphery joint 230, which is located in the hole extension 232, may be lifted by the operator.

The height of the hole extension 232 may be greater than that of the open hole 231, and the width of the hole extension 232 may be greater than that of the open hole 231. Accordingly, the rear end of the opening periphery 110 located in the hole extension 232 of the periphery joint 230 may be easily lifted by a space ensured by the hole extension 232.

Referring back to FIG. 15, the periphery joint 230 may include a third insertion groove 235 into which the opening periphery 110 is inserted from a front side and include a width reducing portion 236 that protrudes toward the case periphery 220 such that the width of the third insertion groove 235 is reduced.

The rear end of the opening periphery 110 may be inserted into the third insertion groove 235 of the periphery joint 230. The third insertion groove 235 may be formed between the periphery joint 230 and the case periphery 220. The third insertion groove 235 may extend in the periphery direction of the detergent opening 100 such that the opening periphery 110 may be inserted into the third insertion groove 235.

The width reducing portion 236 may protrude from the periphery joint 230 toward the case periphery 220. For example, a portion of an upper surface of the third insertion groove 235 may protrude downward to form the width reducing portion 236.

According to an embodiment of the present disclosure, the height of the third insertion groove 235 may be greater than the thickness of the opening periphery 110. Accordingly, the opening periphery 110 may be inserted into the third insertion groove 235. However, the height of the third insertion groove 235 may be greater than the thickness of the opening periphery 110 to facilitate insertion of the opening periphery 110.

The portion of the upper surface of the third insertion groove 235 may protrude toward the opening periphery 110 inserted into the third insertion groove 235, and thus the width reducing portion 236 may reduce a difference in level between upper surfaces of the opening periphery 110 and the third insertion groove 235.

For example, the height of the third insertion groove 235 in the width reducing portion 236 may be lower than the height of the third insertion groove 235 in other portions, and thicknesses of the opening periphery 110 may be substantially the same in all portions. Accordingly, the retract case 200 combined with the opening periphery 110 may effectively prevent shaking or vibration caused by a gap between the third insertion groove 235 and the opening periphery 110.

The number of width reducing portions 236 may vary, and the locations thereof may also vary. FIG. 15 illustrates a state in which two width reducing portions 236 formed on the case periphery 220 defining the upper surface of the retract case 200 are formed according to an embodiment of the present disclosure.

In the opening periphery 110, the opening extension 112 that extends longer than the basic extension described above may be inserted into the third insertion groove 235 of the periphery joint 230. The coupling hole 113 described above may also be formed in the opening extension 112.

As described above, according to an embodiment of the present disclosure, the retract case 200 may include the internal partition 250. The internal partition 250 may be connected to the case periphery 220 and may be penetrated by the storage unit 300 retracted into the cabinet 10.

The storage unit 300 has a front end located in front of the internal partition 250 may be accommodated inside the retract case 200, and the remaining portion excluding the front end may be retracted into the cabinet 10 to pass through the internal partition 250.

As described above, the front end of the storage unit 300 accommodated inside the retract case 200 and surrounded by the case periphery 220 of the retract case 200 may correspond to the handle portion 310. That is, the handle portion 310 exposed out of the cabinet 10 may be provided at the front end of the storage unit 300.

The front end of the storage unit 300 in which the front end of the retract case 200 is accommodated, for example, a portion of the storage unit 300 located behind the handle portion 310 may be accommodated inside the detergent case 400 to pass through the through hole 255 formed in the internal partition 250 of the retract case 200.

The internal partition 250 may be provided to cross the inside of the accommodation space 470 and the retract case 200 of the detergent case 400. The internal partition 250 may be combined with the detergent case 400. Accordingly, the detergent case 400 may be provided inside the cabinet 10 and located behind the retract case 200 to accommodate the remaining portion of the storage unit 300 except for the front end.

According to an embodiment of the present disclosure, the protruding joint 210 may protrude in a first direction and include the first insertion groove 215 into which the opening periphery 110 is inserted. The opening periphery 110 may include the second insertion groove 115 that faces the first insertion groove 215 and into which the protruding joint 210 is inserted and may extend across the first direction to be inserted into the first insertion groove 215.

As a result, according to an embodiment of the present disclosure, the retract case 200 having the first insertion groove 215 may be combined with the opening periphery 110, thereby preventing deformation such as a portion of the retract case 200 sagging toward the inside of the detergent opening 100.

Figure 17:
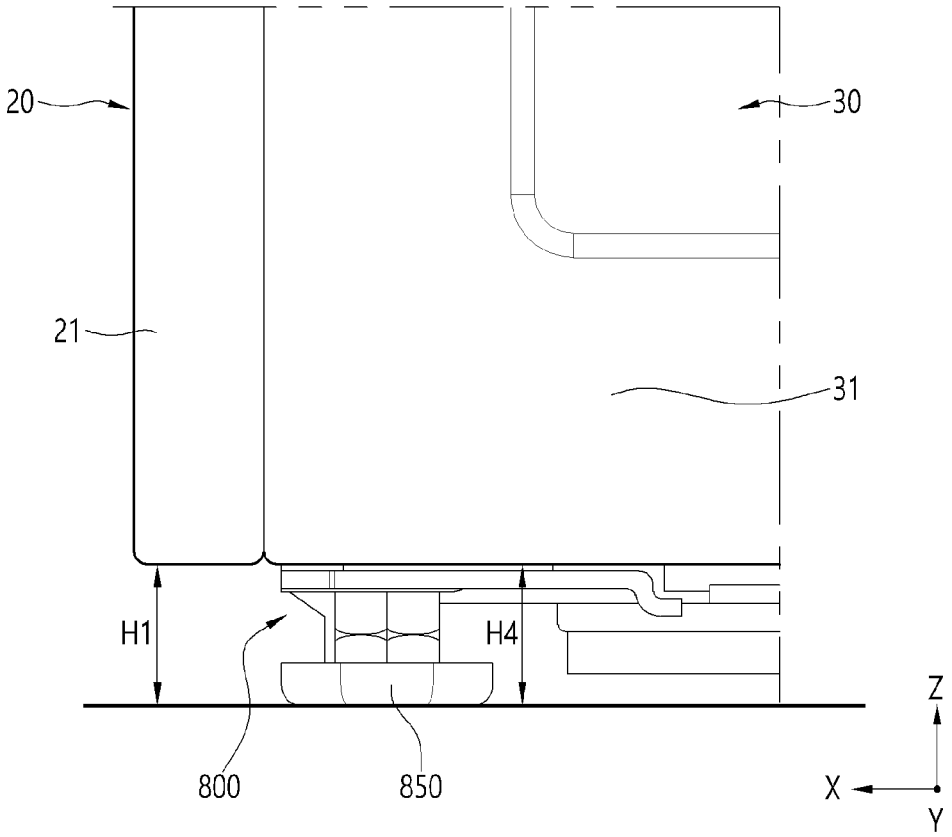
FIG. 17 is a side view of a lower portion of a laundry treating apparatus according to an embodiment of the present disclosure.

FIG. 17 illustrates a side view of a lower portion of the cabinet 10 according to an embodiment of the present disclosure. According to an embodiment of the present disclosure, a height H1 of a lower end of the front panel 20 based on the ground may be the same as that of the side panel 30. According to an embodiment of the present disclosure, components located behind the front panel 20 may be hidden by the front panel 20 from the front side.

Figure 18:
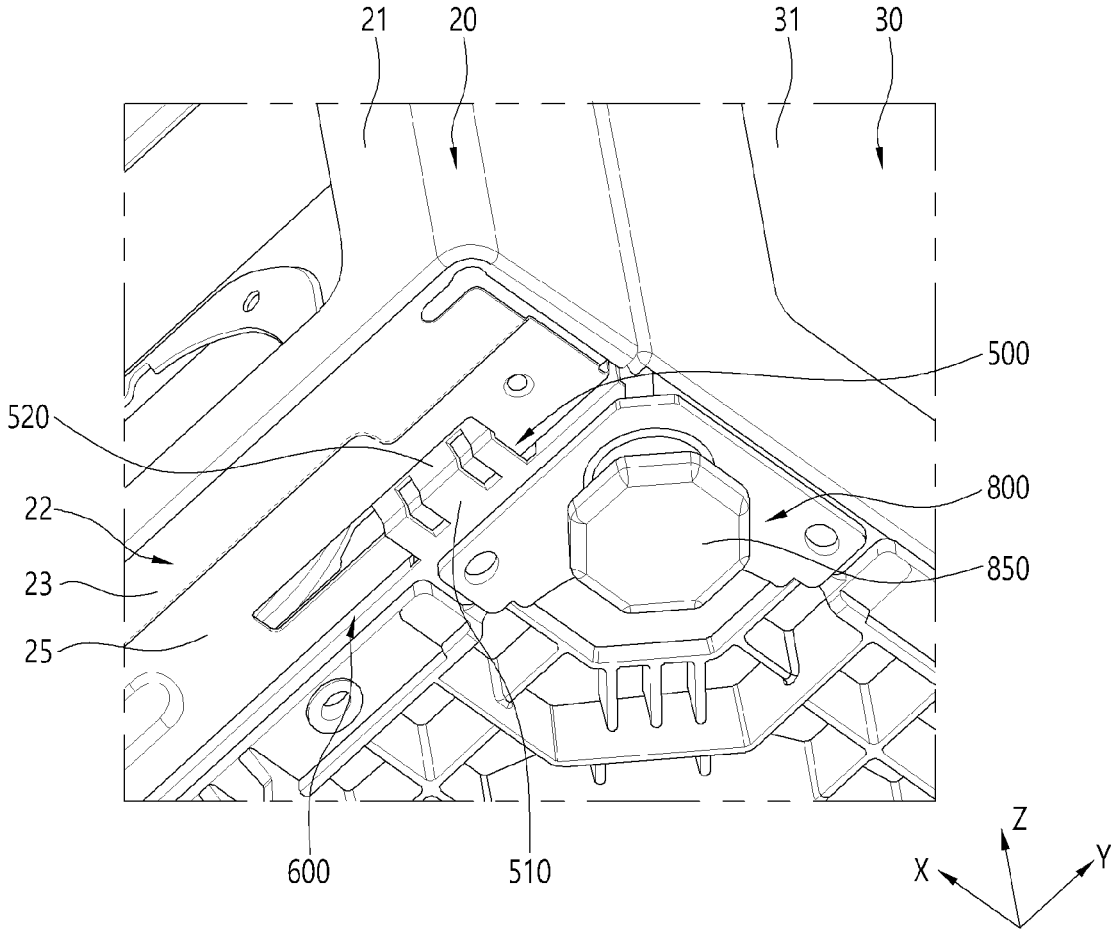
FIG. 18 is a diagram of a laundry treating apparatus viewed from below according to an embodiment of the present disclosure.

FIG. 18 shows a view of a lower portion of the cabinet 10 viewed from below: Referring to FIG. 18, the laundry treating apparatus 1 according to an embodiment of the present disclosure may include a panel support 500.

The panel support 500 may support a lower portion of the front panel 20. That is, at least a portion of the panel support 500 may be located below the front panel 20 and may support the front panel 20 upward.

The panel support 500 may support a load of the front panel 20 to prevent the front panel 20 from moving downward, and further, may effectively determine the height H1 of the front panel 20 to assemble the cabinet 10.

The front panel 20 may include a front portion 21 defining the front surface of the cabinet 10 and a lower bending portion 22 extending rearward from the lower end of the front portion 21. The lower bending portion 22 may protrude rearward from the front portion 21.

The lower bending portion 22 may be formed by bending a lower portion of the front panel 20 rearward or may be manufactured separately from the front portion 21 and then combined with a lower portion of the front portion 21.

Figure 19:
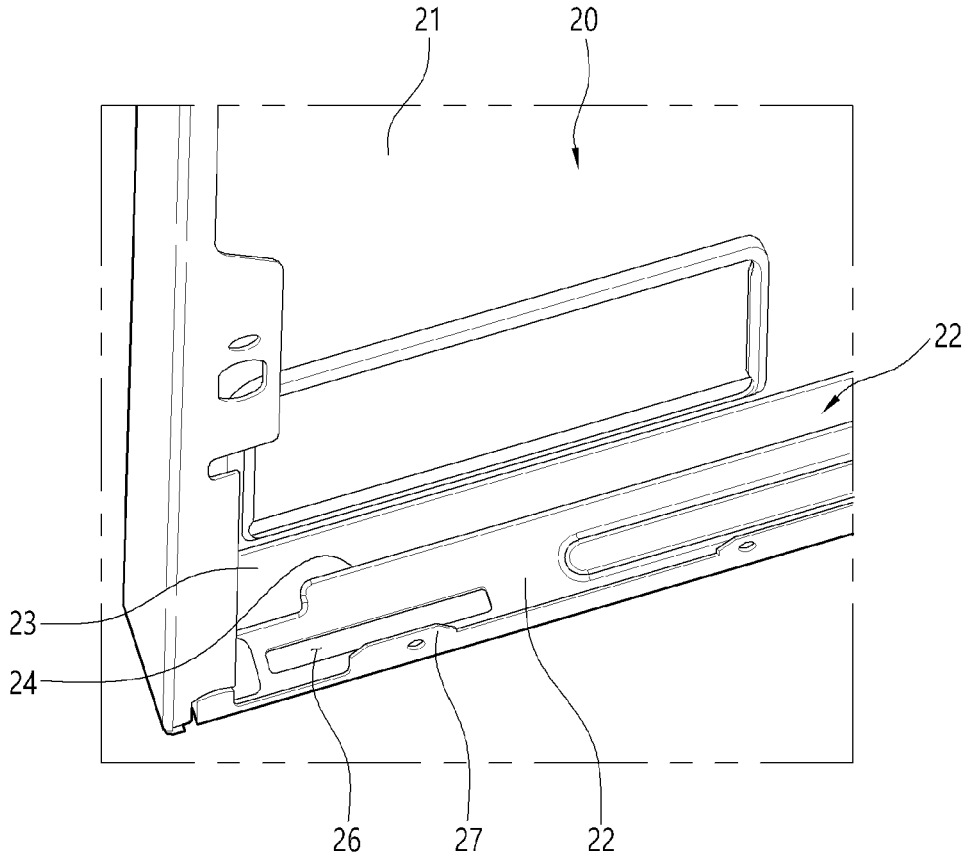
FIG. 19 is a diagram showing a lower bending portion of a front panel viewed from the inside of the cabinet according to an embodiment of the present disclosure.
Figure 20:
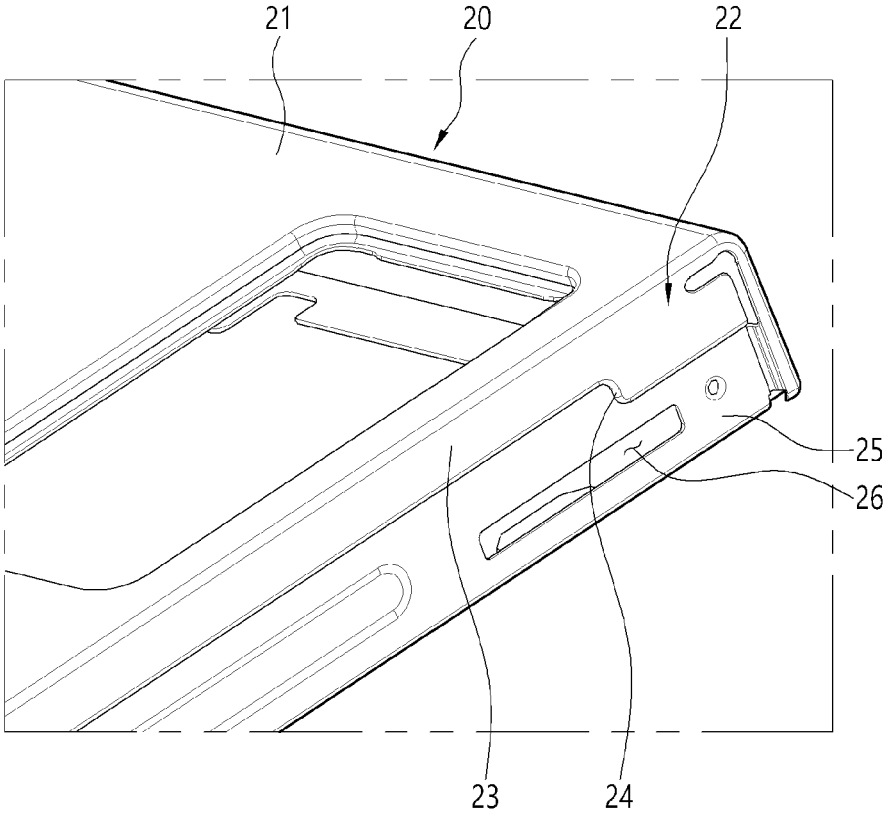
FIG. 20 is a diagram showing a lower bending portion of a front panel viewed from below according to an embodiment of the present disclosure.

FIG. 19 illustrates a second lower surface portion 25 formed on the lower bending portion 22 viewed from the inside of the cabinet 10 according to an embodiment of the present disclosure, and FIG. 20 illustrates the second lower surface portion 25 viewed from below the front panel 20.

Referring to FIGS. 19 and 20, the lower bending portion 22 may include a first lower surface portion 23 and a second lower surface portion 25. The first lower surface portion 23 may extend rearward from the front portion 21. The second lower surface portion 25 may be connected to the first lower surface portion 23 behind the first lower surface portion 23 and may be located higher than the first lower surface portion 23 based on the ground.

The first lower surface portion 23 and the second lower surface portion 25 may together define at least a portion of the lower bending portion 22. The second lower surface portion 25 may be located higher than the first lower surface portion 23 and may be located behind the first lower surface portion 23.

That is, the second lower surface portion 25 may be connected to the rear end of the first lower surface portion 23. A rear end bending portion may be partially raised upward to define the second lower surface portion 25. The panel support 500 may support the second lower surface portion 25 and may be hidden by the front panel 20 from the front side.

According to an embodiment of the present disclosure, the panel support 500 may support the second lower surface portion 25 and the first lower surface portion 23 may be located at the front side, and thus the panel support 500 may be hidden from the front side. In other words, the lower bending portion 22 may have the first lower surface portion 23 having a lower height H1 than the second lower surface portion 25, and thus the second lower surface portion 25 and the panel support 500 may be covered from the front side.

According to an embodiment of the present disclosure, the lower portion of the front panel 20 may be supported upward through the panel support 500 to improve structural stability, and the first lower portion of the lower bending portion 22 may have a first lower end portion having a lower height H1 than the second lower end portion, and thus the panel support 500 may be hidden from the front side, thereby improving the product completeness in appearance and enhancing user satisfaction.

Figure 21:
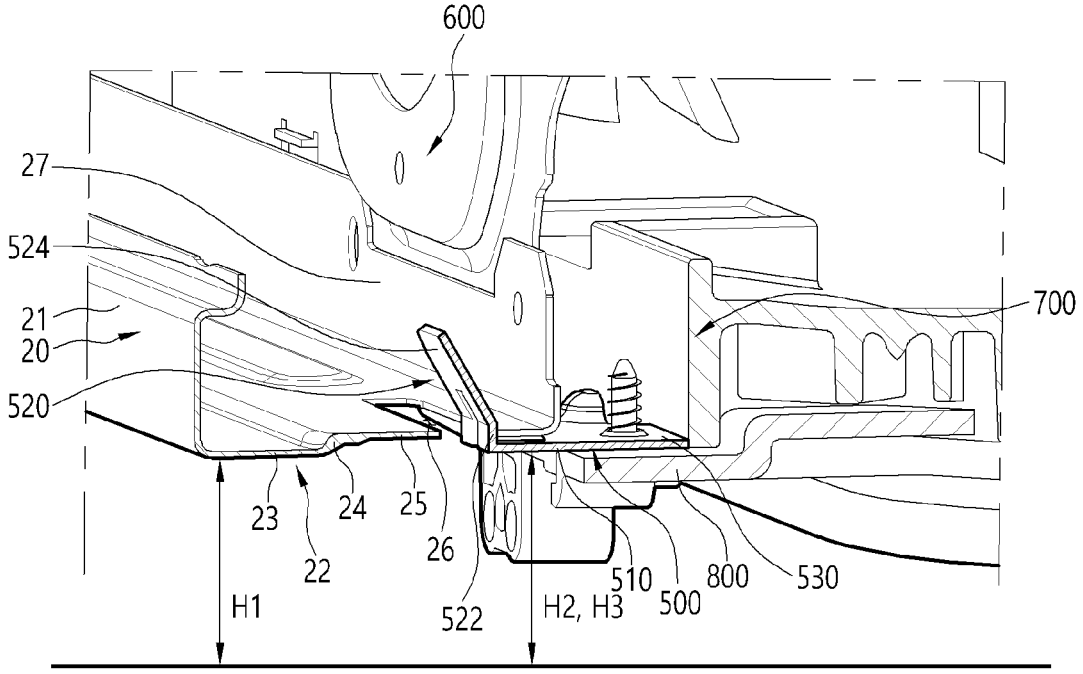
FIG. 21 is a diagram showing a panel support combined with a lower bending portion according to an embodiment of the present disclosure.

FIG. 21 illustrates a cross-section of the lower bending portion 22 of the front panel 20 supported by the panel support 500. Referring to FIG. 21, the second lower surface portion 25 may be connected to the first lower surface portion 23 through a bent portion 24 formed at the rear end of the first lower surface portion 23.

That is, the bent portion 24 may be formed at the rear end of the first lower surface portion 23, and the height of the bent portion 24 may increase away from the first lower surface portion 23, that is, rearward. The front end of the second lower surface portion 25 may be connected to the rear end of the bent portion 24 and may have a greater height H2 than the first lower surface portion 23.

The first lower surface portion 23 and the second lower surface portion 25 may each be arranged parallel to the ground. That is, the first lower surface portion 23 and the second lower surface portion 25 may define a surface that is approximately parallel to the ground, and the bent portion 24 may define a step between the first lower surface portion 23 and the second lower surface portion 25. The first lower surface portion 23, the second lower surface portion 25, and the bent portion 24 may be formed through a forming process such as bending the lower bending portion 22.

The panel support 500 may include a forward extension 510. The forward extension 510 may extend forward from inside the cabinet 10. The rear end of the forward extension 510 may be located behind the rear end of the second lower surface portion 25.

The inside of the cabinet 10 may include a space defined by the front panel 20. For example, the front panel 20 may include a space corresponding to the rear side of the front portion 21 and the upper side of the lower bending portion 22.

The panel support 500 may extend from the inside of the cabinet 10 and may be located below the second lower surface portion 25, thereby supporting the second lower surface portion 25. That is, the panel support 500 may have a joint structure or a fixed structure inside the cabinet 10 to ensure structural stability and extend forward to be at least partially located below the second lower surface portion 25 to ensure structural rigidity for supporting the front panel 20.

According to an embodiment of the present disclosure, the height H1 of the lower end of the first lower surface portion 23 may be greater than or equal to a height H2 of the lower end of the forward extension 510. That is, the lower ends of the first lower surface portion 23 and the front portion 21 may hide the forward extension 510 from the front side. FIG. 21 shows the height H1 of the lower end of the first lower surface portion 23 and the height H2 of the lower end of the forward extension 510.

The panel support 500 may include a through extension 520. The through extension 520 may extend from the forward extension 510 to pass through the second lower surface portion 25. The through extension 520 may extend from the front end of the forward extension 510.

The through extension 520 may extend approximately upward from the forward extension 510. Accordingly, the through extension 520 may penetrate the second lower surface portion 25 from bottom to top. The panel support 500 may have a joint structure that not only supports the front panel 20 upward by the through extension 520 but also prevents separation from the front panel 20.

For example, the lower bending portion 22 of the front panel 20 may be supported upward by the forward extension 510 of the panel support 500 and may pass through the through extension 520 such that forward separation from the panel support 500 may be restricted.

The through extension 520 may include an upward extension 522 and an inclined extension 524. The upward extension 522 may extend from the forward extension 510 upward to pass through the second lower surface portion 25.

The upward extension 522 may extend from the front end of the forward extension 510. However, if necessary, the upward extension 522 may extend from behind the front end of the forward extension 510. The upward extension 522 may extend approximately vertically from the forward extension 510.

For example, the second lower surface portion 25 of the lower bending portion 22 may include a through coupling hole 26 penetrated by the upward extension 522. When the front panel 20 is connected to the cabinet 10, the upward extension 522 may be located within the through coupling hole 26 such that separation of the front panel 20 may be prevented.

The inclined extension 524 may extend obliquely forward from the upward extension 522. For example, the inclined extension 524 may extend obliquely such that the height from the ground increases forward.

However, the inclined extension 524 may not necessarily need to be inclined forward and may be inclined laterally or backward.

The inclined extension 524 may extend from the upward extension 522 and thus may be located within a space defined by the front panel 20. The inclined extension 524 may be located above the second lower surface portion 25.

According to an embodiment of the present disclosure, the inclined extension 524 connected to the upward extension 522 may be provided, and thus the front panel 20 may be effectively prevented from being unintentionally lifted upward and the upward extension 522 may be effectively prevented from being separated from the through coupling hole 26.

For example, according to an embodiment of the present disclosure, when the inclined extension 524 extends forward from the upward extension 522, the inclined extension 524 may pass through the through coupling hole 26 and the upward extension 522 may be located within the through coupling hole 26 while the front panel 20 moves downward toward the panel support 500 and simultaneously moves backward during a process of accommodating the front panel 20 on the panel support 500.

In a process of separating the front panel 20 from the panel support 500, the front panel 20 needs to move upward from the panel support 500 and forward at the same time such that both the upward extension 522 and the inclined extension 524 may pass through the through coupling hole 26 and be separated.

The inclined extension 524 and the upward extension 522 may be manufactured separately and form a mutually coupled relationship, or may be formed as one piece. For example, the upward extension 522 may be formed by bending at the front end of the forward extension 510, and the inclined extension 524 may be formed by bending at an upper end of the upward extension 522.

Figure 22:
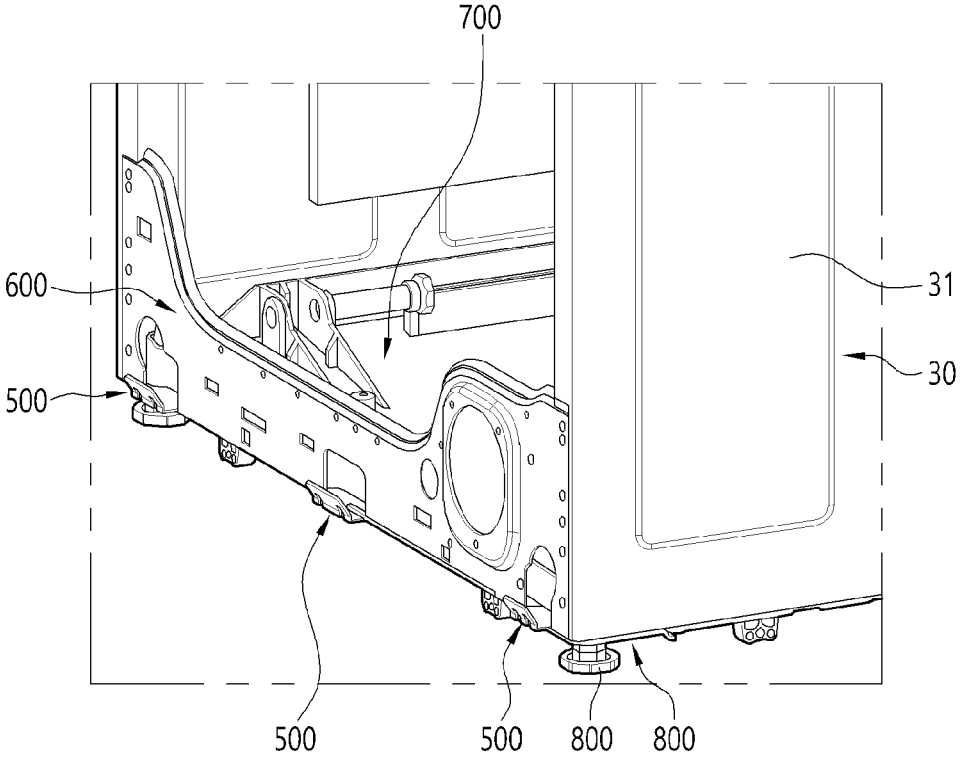
FIG. 22 is a diagram showing a lower frame according to an embodiment of the present disclosure.

FIG. 22 shows a lower frame 600 located below the cabinet 10 behind the front panel 20 according to an embodiment of the present disclosure.

Referring to FIG. 22, the laundry treating apparatus 1 according to an embodiment of the present disclosure may include the lower frame 600 located to face a lower portion of the front panel 20 inside the cabinet 10.

The lower frame 600 may increase the rigidity of the cabinet 10. For example, the lower frame 600 may be provided at a lower portion of the cabinet 10 and may extend in a width direction of the cabinet 10 to connect a first side panel and a second side panel.

That is, the cabinet 10 may be provided with side panels 30 on respective lateral sides, and the lower frame 600 may extend in the lateral direction to be coupled to the side panels 30 that face each other at both ends.

The overall rigidity of the cabinet 10 may be increased by forming a coupling relationship between a plurality of panels through the lower frame 600. The lower frame 600 may be thicker than the front panel 20 or may include high-strength material to increase strength.

The lower frame 600 may be located behind the front panel 20. For example, the lower frame 600 may be located behind the front portion 21 of the front panel 20. The lower frame 600 may be located behind the rear end of the lower bending portion 22. The lower frame 600 may define a surface parallel to the front portion 21.

Figure 23:
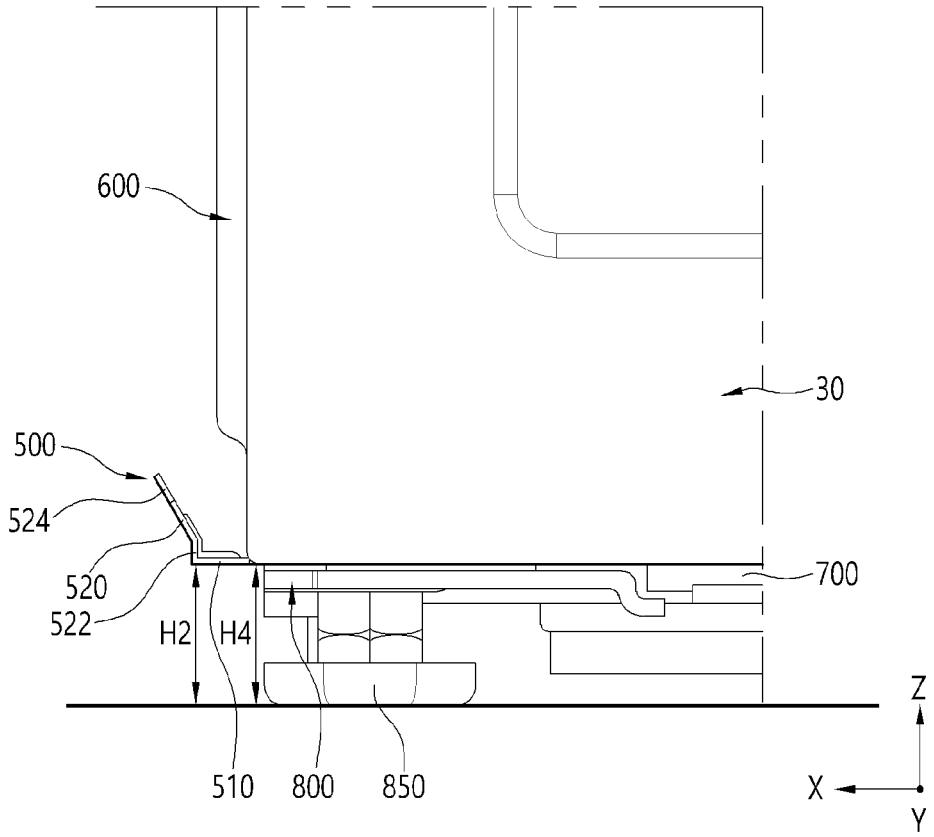
FIG. 23 is a side view of a state in which a front panel is separated in a laundry treating apparatus according to an embodiment of the present disclosure.

FIG. 23 illustrates the panel support 500 protruding forward from the lower frame 600 according to an embodiment of the present disclosure. Referring to FIG. 23, the panel support 500 may be provided on the lower frame 600.

That is, the panel support 500 may protrude forward from the lower frame 600 and support the second lower surface portion 25. The panel support 500 may protrude forward from the lower end of the lower frame 600.

The panel support 500 may be manufactured separately from the lower frame 600 and coupled to the lower frame 600, or may be formed by bending or folding a portion of the lower frame 600. For reference, FIG. 22 illustrates the panel support 500 formed by cutting and bending a portion of the lower frame 600.

According to an embodiment of the present disclosure, the rigidity of a lower portion of the cabinet 10 may be increased through the lower frame 600, and further, the front panel 20 may be stably supported and fixed by providing the panel support 500 on the lower frame 600.

According to an embodiment of the present disclosure, the height H1 of the lower end of the first lower surface portion 23 may be less than or equal to a height H3 of the lower end of the lower frame 600. According to an embodiment of the present disclosure, the panel support 500 may protrude forward from the lower end of the lower frame 600, and thus, the height H3 of the lower end of the lower frame 600 may correspond to a height of the lower end of the panel support 500.

According to an embodiment of the present disclosure, the height H1 of the lower end of the first lower surface portion 23 may correspond to the height H3 of the lower end of the lower frame 600, and the lower frame 600 may be shielded from the front side by the lower ends of the first lower surface portion 23 and the front portion 21.

For reference, FIG. 21 illustrates a state in which the height H1 of the first lower surface portion 23 is less than the height H3 of the lower end of the forward extension 510 or the lower frame 600 according to an embodiment of the present disclosure.

Referring back to FIGS. 18 and 21, according to an embodiment of the present disclosure, the cabinet 10 may further include the base portion 700 defining a lower surface. The base portion 700 may have a space defined thereon for installing or accommodating various internal configurations.

The lower surface of the base portion 700 may correspond to the lower surface of the cabinet 10. That is, within the cabinet 10, the base portion 700 in which various internal components are installed may be exposed downward of the cabinet 10 to define the lower surface of the cabinet 10.

The lower frame 600 may be located in front of the base portion 700. That is, the lower frame 600 may partition a space between the front panel 20 and the base portion 700.

The laundry treating apparatus 1 according to an embodiment of the present disclosure may include a leg mounting portion 800. The leg mounting portion 800 may be coupled to the base portion 700 under the base portion 700 and may include a leg portion 850 for supporting the cabinet 10.

The leg portion 850 may be a device for supporting a load of the cabinet 10 from the ground, or the like. The leg mounting portion 800 may correspond to a portion of the base portion 700 or may be manufactured separately from the base portion 700 and then coupled to the base portion 700.

FIG. 18 illustrates the leg mounting portion 800 that is manufactured separately from the base portion 700 and coupled to a lower surface of the base portion 700 according to an embodiment of the present disclosure. The leg mounting portion 800 may be partially formed in a plate shape and may be coupled to the lower surface of the base portion 700.

However, the leg mounting portion 800 or the leg portion 850 may be removed as needed. For example, when the laundry treating apparatus 1 according to an embodiment of the present disclosure may include the additional treating device 90 and the basic treating device described above is located above the additional treating device 90, the leg mounting portion 800 or the leg portion 850 may be disadvantageous for the basic treating device to be installed on the additional treating device 90, and in this case, the basic treating device may be positioned above the additional cabinet 95 of the cabinet 10 while the leg mounting portion 800 or the leg portion 850 is removed.

As shown in FIG. 18, the leg mounting portion 800 may support the lower frame 600 below the lower frame 600. That is, the lower frame 600 may be located in front of the base portion 700, and at least a portion of the leg mounting portion 800 may be located below the lower frame 600 to support the leg mounting portion 800 upward.

The lower frame 600 may be stably fixed by forming a coupling relationship with the leg mounting portion 800. However, the leg mounting portion 800 may indirectly support the lower frame 600 through the base portion 700, and the leg mounting portion 800 and the base portion 700 may be provided as one piece.

The panel support 500 may include an additional extension 530 extending rearward from the lower frame 600. That is, the lower frame 600 may include the additional extension 530 extending rearward from the panel support 500.

The additional extension 530 may extend rearward from the forward extension 510 of the panel support 500. The additional extension 530 may extend rearward from the rear end of the forward extension 510. The additional extension 530 may have the same height as the forward extension 510. The additional extension 530 may be formed integrally with the forward extension 510 or manufactured separately to form a coupling relationship with the forward extension 510.

The leg mounting portion 800 may be combined with the additional extension 530 below the additional extension 530. That is, according to an embodiment of the present disclosure, the lower frame 600 may define a surface substantially parallel to the front portion 21, the additional extension 530 extending rearward may be provided on the lower frame 600 to be supported by the leg mounting portion 800 having a surface substantially parallel to the ground, and at least a portion of the leg mounting portion 800 may be located below the additional extension 530 and combined with the additional extension 530.

FIG. 21 illustrates a state in which the additional extension 530 is coupled to a portion of the leg mounting portion 800, which is located below the additional extension 530, by using a coupler such as a bolt.

The lower bending portion 22 may include a frame joint 27. The frame joint 27 may be connected to the rear end of the second lower surface portion 25 and may face the lower frame 600 to be combined with the lower frame 600.

That is, the front panel 20 may be formed by bending the lower bending portion 22 at the lower end of the front portion 21, and the lower bending portion 22 may be formed by sequentially bending and forming the first lower surface portion 23, the bent portion 24, and the second lower surface portion 25 and bending the frame joint 27 upward from the rear end of the second lower surface portion 25.

The frame joint 27 may be located in front of the lower frame 600 to have one surface facing the lower frame 600. The frame joint 27 may be combined with the lower frame 600. For example, the frame joint 27 may be combined with the lower frame 600 through a coupler such as a bolt, and accordingly, may strengthen the fixing force and joining force of the front panel 20.

Referring back to FIG. 17, according to an embodiment of the present disclosure, the cabinet 10 may further include the side panel 30 located on each of the lateral sides, and the height H1 of the lower end of the first lower surface portion 23 may be equal to a height H4 of the lower end of the side panel 30.

The height H1 of the lower end of the first lower surface portion 23 may ultimately correspond to a height of the lower end of the front panel 20. The height H4 of the lower end of the side panel 30 may correspond to a lower end of a lateral surface portion 31 defining a lateral surface of the cabinet 10 in the side panel 30. That is, according to an embodiment of the present disclosure, the lower end of the front panel 20 may be located parallel to the lower end of the side panel 30 based on the ground.

According to an embodiment of the present disclosure, the second lower surface portion 25 having a different height from the first lower surface portion 23 may be formed, and the panel support 500 may support the second lower surface portion 25, and thus the lower end of the front panel 20 and the lower end of the side panel 30 may be effectively aligned by adjusting, by design, a height relationship between the first lower surface portion 23 and the second lower surface portion 25.

Figure 24:
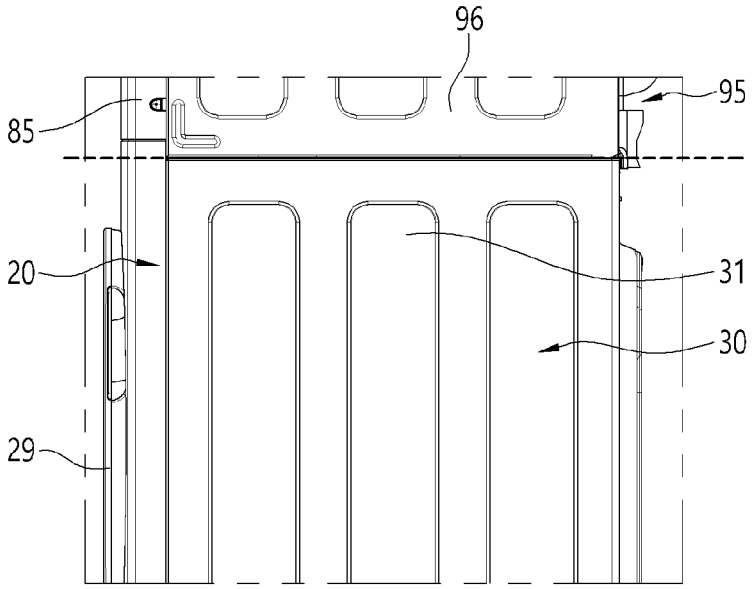
FIG. 24 is a side view of a joint portion of an additional treating device and a basic treating device according to an embodiment of the present disclosure.

FIG. 24 illustrates a connection portion of the cabinet 10 and the additional cabinet 95 in the laundry treating apparatus 1 including the additional treating device 90 according to an embodiment of the present disclosure. The drawing shows a state in which the upper end of the front panel 20 of the cabinet 10 protrudes higher than the upper end of the side panel 30.

According to an embodiment of the present disclosure, when the additional treating device 90 is provided, the basic treating device is located on the ground, and the additional treating device 90 may be located above the basic treating device.

In this case, the front panel 20 of the cabinet 10 of the basic treating device may be located such that an upper end of the front panel 20 protrudes upward more than the side panel 30, thereby restricting the additional cabinet 95 from moving forward.

That is, according to an embodiment of the present disclosure, the front panel 20 may improve the appearance of the product by having a lower end of the front panel 20 parallel to the lower end of the side panel 30, and an upper end of the front panel 20 may stably fix the additional cabinet 95 by protruding above the upper end of the side panel 30.

The additional cabinet 95 of the additional treating device 90 may include additional side panels 96 arranged on respective lateral sides. The upper end of the front panel 20 may be located in front of the additional side panel 96 to limit forward movement of the additional cabinet 95.

In other words, in the laundry treating apparatus 1 according to an embodiment of the present disclosure, the panel support 500 may support the lower portion of the front panel 20, and the lower bending portion 22 and the panel support 500 may be hidden by the front portion 21 from the front side.

While the present disclosure has been illustrated and described with respect to specific embodiments thereof, it will be apparent to those of skill in the art that the present disclosure may be variously improved and modified without departing from the technical spirit of the disclosure as defined by the following claims.

The invention claimed is:

1. A laundry treating apparatus comprising:

a cabinet including a detergent opening;

a tub provided inside the cabinet and storing water;

a drum provided inside the tub and configured to accommodate laundry;

an opening periphery extending along a periphery of the detergent opening and protruding into the cabinet;

a storage unit in which detergent is stored and retracted into the cabinet through the detergent opening; and a retract case combined with the opening periphery and accommodates at least a portion of the storage unit retracted into the cabinet, wherein the retract case includes a protruding joint that extends toward the opening periphery and has a portion that faces the opening periphery and into which the opening periphery is inserted, wherein a second insertion groove into which the protruding joint is inserted is formed in a portion of the opening periphery, which faces the first insertion groove, and wherein the protruding joint is configured to be inserted into the second insertion groove while the opening periphery is inserted into the first insertion groove.

2. The laundry treating apparatus of claim 1, wherein the protruding joint protrudes in a direction away from the storage unit in the retract case, and wherein a portion of the opening periphery, which extends in a direction crossing a protruding direction of the protruding joint, includes the second insertion groove and is configured to be inserted into the first insertion groove.

3. The laundry treating apparatus of claim 1, wherein the protruding joint is provided in plural and protruding joints are spaced apart from each other along the periphery of the detergent opening.

4. The laundry treating apparatus of claim 1, wherein the detergent opening is formed on the front panel of the cabinet, and wherein the storage unit is configured to be retracted into the cabinet reward through the detergent opening.

5. The laundry treating apparatus of claim 4, wherein the protruding joint configured to be protrude upward from the retract case, and wherein the opening periphery is located above the detergent opening and has a portion extending laterally is inserted into the first insertion groove.

6. The laundry treating apparatus of claim 4, wherein a portion of the protruding joint, which is located behind the first insertion groove, is located in the second insertion groove, and wherein a portion of the opening periphery, which is located in front of the second insertion groove, is located within the first insertion groove.

7. The laundry treating apparatus of claim 4, wherein the retract case further includes a case periphery surrounding the at least portion of the storage unit; and wherein a periphery joint that protrudes outward from the case periphery and into which the opening periphery is inserted from a front side, and wherein a front end of the protruding joint is located forward of the periphery joint.

8. The laundry treating apparatus of claim 7, wherein the protruding joint includes:

wherein a body portion protruding outward from the case periphery; and wherein a forward extension extending forward from the body portion and having the first insertion groove formed between the forward extension and the case periphery.

9. The laundry treating apparatus of claim 7, wherein the front end of the case periphery is located within the opening periphery.

10. The laundry treating apparatus of claim 9, wherein the retract case further includes a through joint that protrudes outward from the case periphery and passes through the opening periphery.

11. The laundry treating apparatus of claim 10, wherein the through joint is configured to have a rib shape extending in the periphery direction of the detergent opening.

12. The laundry treating apparatus of claim 10, wherein the through joint is provided in plural and through joins are spaced apart from each other in the periphery direction, and wherein the protruding joint is located between one pair of the through joints.

13. The laundry treating apparatus of claim 10, wherein the through joint is located forward of the periphery joint, and wherein a portion of the opening periphery, which is located behind the through joint, is inserted into the periphery joint.

14. The laundry treating apparatus of claim 10, wherein an open hole passing through the periphery joint rearward is formed at a front portion of the periphery joint, at which the through joint is located.

15. The laundry treating apparatus of claim 14, wherein the periphery joint further includes a hole extension formed on one surface of the periphery joint, which faces the detergent opening, and recessed rearwardly while surrounding the open hole.

16. The laundry treating apparatus of claim 7, wherein the periphery joint includes a third insertion groove into which the opening periphery is inserted from a front side, and a width reducing portion protruding toward the case periphery is provided in at least a portion of the third insertion groove such that a width of the third insertion groove is reduced compared with a remaining portion of the third insertion groove.

17. The laundry treating apparatus of claim 7, wherein the retract case further includes an internal partition facing the detergent opening and penetrated by the storage unit, and wherein a front end of the storage unit, which is located in front of the internal partition, is configured to be accommodated in the retract case, and a remaining portion excluding the front end is located behind the internal partition.

18. The laundry treating apparatus of claim 17, further comprising a detergent case provided inside the cabinet and located behind the retract case to accommodate the remaining portion of the storage unit.

19. The laundry treating apparatus of claim 17, wherein a handle portion exposed to an outside of the cabinet on the front end of the storage unit.

20. A laundry treating apparatus comprising:

a cabinet including a detergent opening;

a tub provided inside the cabinet and storing water;

a drum provided inside the tub and configured to accommodate laundry;

an opening periphery extending along a periphery of the detergent opening and protruding into the cabinet;

a storage unit in which detergent is stored and retracted into the cabinet through the detergent opening; and a retract case combined with the opening periphery inside the cabinet and accommodates at least a portion of the storage unit retracted into the cabinet, wherein the retract case includes a protruding joint protruding in a first direction and including a first insertion groove into which the opening periphery is inserted, and wherein the opening periphery is configured to extend across the first direction and is inserted into the first insertion groove and includes a second insertion groove that faces the first insertion groove and into which the protruding joint is inserted.

* * * * *